US008777545B2

(12) United States Patent
Roux

(10) Patent No.: US 8,777,545 B2
(45) Date of Patent: Jul. 15, 2014

(54) FREE LIFT MAST FOR TRUCK MOUNTED FORKLIFT

(75) Inventor: Francois Roux, Nacogdoches, TX (US)

(73) Assignee: Bright Coop, Inc., Nacogdoches, TX (US)

( * ) Notice: Subject to any disclaimer, the term of this patent is extended or adjusted under 35 U.S.C. 154(b) by 1235 days.

(21) Appl. No.: 12/647,443

(22) Filed: Dec. 26, 2009

(65) Prior Publication Data

US 2011/0091306 A1 Apr. 21, 2011

Related U.S. Application Data

(60) Provisional application No. 61/279,364, filed on Oct. 20, 2009.

(51) Int. Cl.

| | |
|---|---|
| ***B66F 9/10*** | (2006.01) |
| ***B66F 9/075*** | (2006.01) |
| ***B66F 9/22*** | (2006.01) |
| ***B66F 9/08*** | (2006.01) |

(52) U.S. Cl.

CPC ..... *B66F 9/07563* (2013.01); *B66F 9/22* (2013.01); *B66F 9/08* (2013.01)

USPC ..... 414/631; 187/230; 187/234; 187/274

(58) Field of Classification Search

USPC ..... 414/631; 187/230, 234, 274, 275

See application file for complete search history.

(56) References Cited

U.S. PATENT DOCUMENTS

| | | | | |
|---|---|---|---|---|
| 2,399,632 | A | 5/1946 | Guerin | |
| 2,653,678 | A | 9/1953 | Lehrman | |
| 2,918,143 | A | 12/1959 | Shaffer | |
| 2,932,419 | A | 4/1960 | Harris | |
| 3,048,550 | A | 7/1962 | Carr | |
| 3,077,951 | A | 2/1963 | Ramsey | |
| 3,080,943 | A | 3/1963 | Goodall | |
| 3,273,665 | A | 7/1968 | Goodyear | |
| 3,433,324 | A | 3/1969 | McIntosh | |
| 3,433,325 | A | 3/1969 | McIntosh | |
| 3,506,092 | A | 4/1970 | Shinoda | |
| 3,561,568 | A | 2/1971 | Hansen | |
| 3,587,784 | A | 6/1971 | Talt | |
| 3,691,911 | A * | 9/1972 | Visser | 91/171 |

(Continued)

*Primary Examiner* — Gregory Adams
*Assistant Examiner* — Willie Berry, Jr.
(74) *Attorney, Agent, or Firm* — Tim L. Burgess

(57) ABSTRACT

A multi-lift mast for a forklift has hydraulic circuitry that provides free lift and negative lift capabilities for the forklift. The mast comprises a stationary member, at least one extensible member slideable on the stationary member and a carriage slideable on an extensible member. The extensible mast members are raised and lowered by double acting hydraulic actuators extending between the stationary member and an extensible member. The carriage is raised and lowered by a positively connected double acting carriage hydraulic actuator extending between an extensible mast and the carriage. The circuitry employs identical pairs of counterbalance valves controlling the supply and exit of hydraulic fluid for the bore and rod ends of the actuators, set to cause the carriage to fully extend before the extensible mast members extend, providing free lift, and set to cause the extensible mast members to fully lower before the carriage lowers. The hydraulic circuitry prevents the extensible masts from rising when forks of an elevated carriage are inserted in receivers on a hauling vehicle and the circuitry is operated as if to lower the carriage, causing the carriage to pull up the extensible mast and so lift the forklift off the ground (negative lift) for piggybacking on the hauling vehicle.

15 Claims, 15 Drawing Sheets

(56) References Cited

U.S. PATENT DOCUMENTS

| | | | |
|---|---|---|---|
| 3,774,726 | A | 11/1973 | Bredberg |
| 3,774,727 | A | 11/1973 | Berkestad |
| 3,786,902 | A | 1/1974 | Ramsey |
| 3,841,442 | A | 10/1974 | Erickson |
| 3,871,494 | A | 3/1975 | Kelly |
| 3,894,616 | A | 7/1975 | Kawanishi |
| 3,930,563 | A | 1/1976 | Abels |
| 3,933,224 | A | 1/1976 | Nilsson |
| 3,957,165 | A | 5/1976 | Smith |
| 3,968,859 | A | 7/1976 | Ehrhardt |
| 4,009,765 | A | 3/1977 | Leskovec |
| 4,015,686 | A | 4/1977 | Bushnell |
| 4,026,432 | A | 5/1977 | Abels |
| 4,051,970 | A | 10/1977 | Ramsey |
| 4,099,541 | A | 7/1978 | Binkley |
| 4,155,428 | A | 5/1979 | Hansen |
| 4,161,256 | A | 7/1979 | Seaberg |
| 4,219,302 | A | 8/1980 | Leskovec |
| 4,231,450 | A | 11/1980 | Hedtke |
| 4,238,004 | A | 12/1980 | Olson |
| 4,261,438 | A | 4/1981 | Olson |
| 4,280,592 | A | 7/1981 | Bartow |
| 4,307,792 | A | 12/1981 | Benson |
| 4,312,427 | A | 1/1982 | Stedman |
| 4,356,893 | A | 11/1982 | Johanson |
| 4,365,921 | A | 12/1982 | Brouwer |
| 4,374,550 | A | 2/1983 | Bartow |
| 4,392,554 | A | 7/1983 | Russey |
| 4,421,208 | A | 12/1983 | Robinson |
| 4,427,093 | A | 1/1984 | Wehmeyer |
| 4,436,183 | A | 3/1984 | Laurich-Troust |
| 4,449,365 | A | 5/1984 | Hancock |
| 4,449,614 | A | 5/1984 | Matsuda |
| 4,467,894 | A | 8/1984 | Sinclair |
| 4,476,960 | A | 10/1984 | Yarris |
| 4,552,250 | A | 11/1985 | Luebrecht |
| 4,573,319 | A | 3/1986 | Chichester |
| 4,585,093 | A | 4/1986 | Barda |
| 4,592,449 | A | 6/1986 | Sakata |
| 4,593,791 | A | 6/1986 | Matthews |
| 4,600,084 | A | 7/1986 | Ray |
| 4,621,711 | A | 11/1986 | Miyashige |
| 4,629,391 | A | 12/1986 | Soyk |
| 4,635,757 | A | 1/1987 | Yamagishi |
| 4,657,471 | A | 4/1987 | Shinoda |
| 4,665,698 | A | 5/1987 | Trusock |
| 4,683,987 | A | 8/1987 | Sakata |
| 4,683,988 | A | 8/1987 | Shrum |
| 4,721,187 | A | 1/1988 | Riddle |
| 4,762,203 | A | 8/1988 | Ryan |
| 4,799,851 | A | 1/1989 | Swanson |
| 4,889,038 | A | 12/1989 | Bentivoglio |
| 4,896,748 | A | 1/1990 | Mikkelsen |
| 4,949,816 | A | 8/1990 | Brown |
| 5,012,898 | A | 5/1991 | Tsymberov |
| 5,036,952 | A | 8/1991 | Harper |
| 5,082,090 | A | 1/1992 | Walker |
| 5,110,251 | A | 5/1992 | Gray |
| 5,174,415 | A | 12/1992 | Neagle |
| 5,188,248 | A | 2/1993 | Dohnalik |
| 5,238,086 | A | 8/1993 | Aoki |
| 5,320,197 | A | 6/1994 | Connerley |
| 5,326,217 | A | 7/1994 | Simpson |
| 5,328,321 | A | 7/1994 | Moffett |
| 5,330,032 | A | 7/1994 | Warner |
| 5,361,872 | A | 11/1994 | Nishimyo |
| 5,374,156 | A | 12/1994 | Simpson |
| 5,394,903 | A | 3/1995 | Tominaga |
| 5,462,136 | A | 10/1995 | Schoenmaker |
| 5,480,275 | A | 1/1996 | Talbert et al. |
| 5,513,943 | A | 5/1996 | Lugash |
| 5,641,261 | A | 6/1997 | Talbert |
| 5,657,834 | A | 8/1997 | Plaugher |
| 5,984,050 | A | 11/1999 | Ronald |
| 5,992,571 | A | 11/1999 | Lee |
| 6,022,183 | A | 2/2000 | Walters |
| 6,125,970 | A | 10/2000 | Takeuchi |
| 6,164,415 | A | 12/2000 | Takeuchi |
| 6,193,015 | B1 | 2/2001 | Kato |
| 6,296,081 | B1 | 10/2001 | Nagai |
| 6,308,612 | B1 | 10/2001 | Emanie |
| 6,390,751 | B2 | 5/2002 | Jordan |
| 6,431,816 | B1 | 8/2002 | Jordan |
| 6,439,826 | B1 | 8/2002 | Jordan |
| 6,454,511 | B1 | 9/2002 | Jordan |
| 6,505,710 | B1 | 1/2003 | Kato |
| 6,843,636 | B2 | 1/2005 | Jordan |
| 7,001,131 | B2 | 2/2006 | O'Keeffe |
| 7,018,159 | B2 | 3/2006 | Jordan |
| 7,096,999 | B2 | 8/2006 | Lewis |
| 7,175,000 | B2 | 2/2007 | Gyllenhammar |
| 7,188,709 | B2 | 3/2007 | Hofmann |
| 7,219,769 | B2 | 5/2007 | Yamanouchi |
| 7,240,771 | B2 | 7/2007 | Perkins |
| 7,255,202 | B2 | 8/2007 | O'Keeffe |
| 7,299,897 | B2 | 11/2007 | Stockman |
| 7,395,901 | B2 | 7/2008 | Hayashi |
| 7,398,859 | B2 * | 7/2008 | Lewis et al. ..... 187/226 |
| 2007/0207023 | A1 | 9/2007 | O'Keeffe |
| 2008/0095578 | A1 | 4/2008 | Farber |
| 2008/0292437 | A1 | 11/2008 | Keenan |
| 2009/0032338 | A1 | 2/2009 | Cano |

* cited by examiner

FREE LIFT MAST FOR TRUCK MOUNTED FORKLIFT

CROSS-REFERENCE TO RELATED APPLICATIONS

This application claims the benefit of the filing date of U.S. Provisional Patent Application No. 61/279,364, filed on Oct. 20, 2009, the disclosures of which are incorporated herein by reference.

STATEMENT REGARDING FEDERALLY SPONSORED RESEARCH OR DEVELOPMENT

Not Applicable.

FIELD OF DISCLOSURE OR TECHNICAL FIELD

This disclosure relates to extensible vertical guides for load support extended by ram drives for use on forklifts, and to hydraulic systems for sequencing ram drives for extensible guides and load supports.

BACKGROUND OF THE DISCLOSURE

Vertical guides called masts are attached to motor driven vehicles, generally called tractors or trucks, for raising and lowering loads on a carriage slideable along the mast. Where the carriage mounts fork tines ("forks"), the trucks mounting the masts are known as forklifts. The term forklift has come to be used generically without regard to whether the carriage incorporates forks or not, and is so used herein. Extensible mast structures in which one mast member slides along another mast member allow a load carriage slideably mounted on the highest reaching mast member to be lifted higher than when the load carriage is mounted on a non-extensible mast. Ram drives alone or in combination with various systems of chains guided around pulleys or sprockets usually provide the motive power to lift the extensible masts. The extensible masts and the chains used to extend them are heavy. Forklifts for industrial use in warehouses and other fixed locations were developed many years ago that possess the ability to lift carriages and the loads on them without having to lift an extensible mast member. This ability is called "free lift." The "free" in "free lift" means the carriage can be lifted without having to lift the extensible masts and associated chain and guide structures, saving time, gaining job efficiency and reducing wear and tear on the machine. In addition, by not having to lift extensible mast members to lift the load carriage, the forklift can work in areas of limited overhead clearance.

Some forklifts, called "truck mounted forklifts" are constructed to "piggyback" on the rear of a hauling vehicle such as a trailer pulled by a truck (as opposed to being driven onto a trailer and carried atop the trailer). The piggybacked forklift can be transported to a site, dismounted, and used to lift a load off the hauling vehicle and place the load at the site, or pick up a load at the site and place it on the hauling vehicle, or otherwise move loads at the site. In order to provide for piggybacking a truck mounted forklift, forklift receivers are constructed on the rear of a hauling vehicle for receiving the forks of the carrier. In order to piggyback itself onto a receiver fitted hauling vehicle, the truck mountable forklift elevates a fork carriage to a level of the fork receivers on a hauling vehicle, advances the forks into the receivers, and then operates the forklift as if to lower the carriage. However, since the elevated forks are fixed in the receivers, rather than the carriage descending, the rest of the forklift moves upwardly on the carriage, raising itself off the ground, allowing the forklift to be transported on the hauling vehicle. This lifting of the forklift by driving the forklift up the fixed fork carriage is called "negative lift." Negative lift requires an ability either to positively pull or push the fork carriage down.

Examples of a mast lift system employing rams and chains to drive the carriage up or down and give negative lift capability are U.S. Pat. No. 4,921,075 and U.S. Pat. No. 5,328,321. The former patent describes a two stage mast system, and the latter a three stage mast system. In both, an arrangement of chains and pulleys positively lifts and lowers a carriage responsive to a double acting hydraulic ram mounted to a stationary mast section lifting or lowering an extensible mast slideable on the stationary mast. The system exemplified by these patents requires that the extensible mast member or members be raised in order to raise the fork carriage to an elevation allowing the forks to be inserted into fork receivers on a hauling vehicle. Because the fork carriage cannot be raised without raising the extensible mast members, this system does not have free lift. Further, because the extensible mast sections must be extended to lift the forks on the fork carriage, the height of the forklift is increased during operation, limiting usefulness of the forklift in areas with limited overhead clearance.

On the other hand, the usual free lift system is not capable of negative lift. The usual manner of free lifting a fork carriage is by indirection, using a chain fixed to a stationary location, passed over a wheel or sprocket, and attached at the other end to the carriage. The axle of the wheel or sprocket is borne on a clevis or other mounting device at the end of a rod of an upright hydraulic actuator. When the rod elevates as fluid pressure is applied to the actuator, the wheel or sprocket is raised, lifting the chain and pulling the carriage upwardly without lifting the extensible masts. The chain prevents the carriage from moving downward while the rod of the hydraulic actuator is extended. However, only gravity restrains upward movement of the carriage. If the rod of the hydraulic actuator for the carriage is extended for placement of the forks in receivers in a hauling vehicle, operation of the mast lift actuators to lower the extensible mast members will not prevent the carriage from sliding up an inner mast section on which the carriage is supported. Thus the typical free lift system cannot be used for piggyback transportation.

U.S. Pat. No. 7,255,202 describes an effort to accomplish both free lift and negative lift with a carriage slideable on an innermost extensible mast of a forklift truck. Free lift is obtained in the usual way with a chain fixed at one end and with the other end attaching to the carriage and passing over a wheel mounted on a rod of a ram (hydraulic actuator) mounted right side up on a lower cross member of the innermost extensible mast member. The carriage is prevented from sliding up the innermost mast section by a hydraulic actuator mounted upside down to an upper cross member of the innermost extensible mast member, with a chain fixed at one end and with the other end attached to the carriage and passing under a wheel carried by the rod of the upside down actuator. When the rod of the upside down actuator is raised, the pulleyed chain pulls the carriage down, and so long as held down by the raised rod of the upside down actuator, the carriage is preventing from sliding up the innermost mast section when forks on the carriage are held secured at an elevated position. The two carriage actuators interchange the hydraulic fluid actuating them, so that fluid is pumped from one to the other to retract the rod of the one and extend the rod of the other, and vice versa.

DETAILED DESCRIPTION OF EMBODIMENTS

Figure 1:
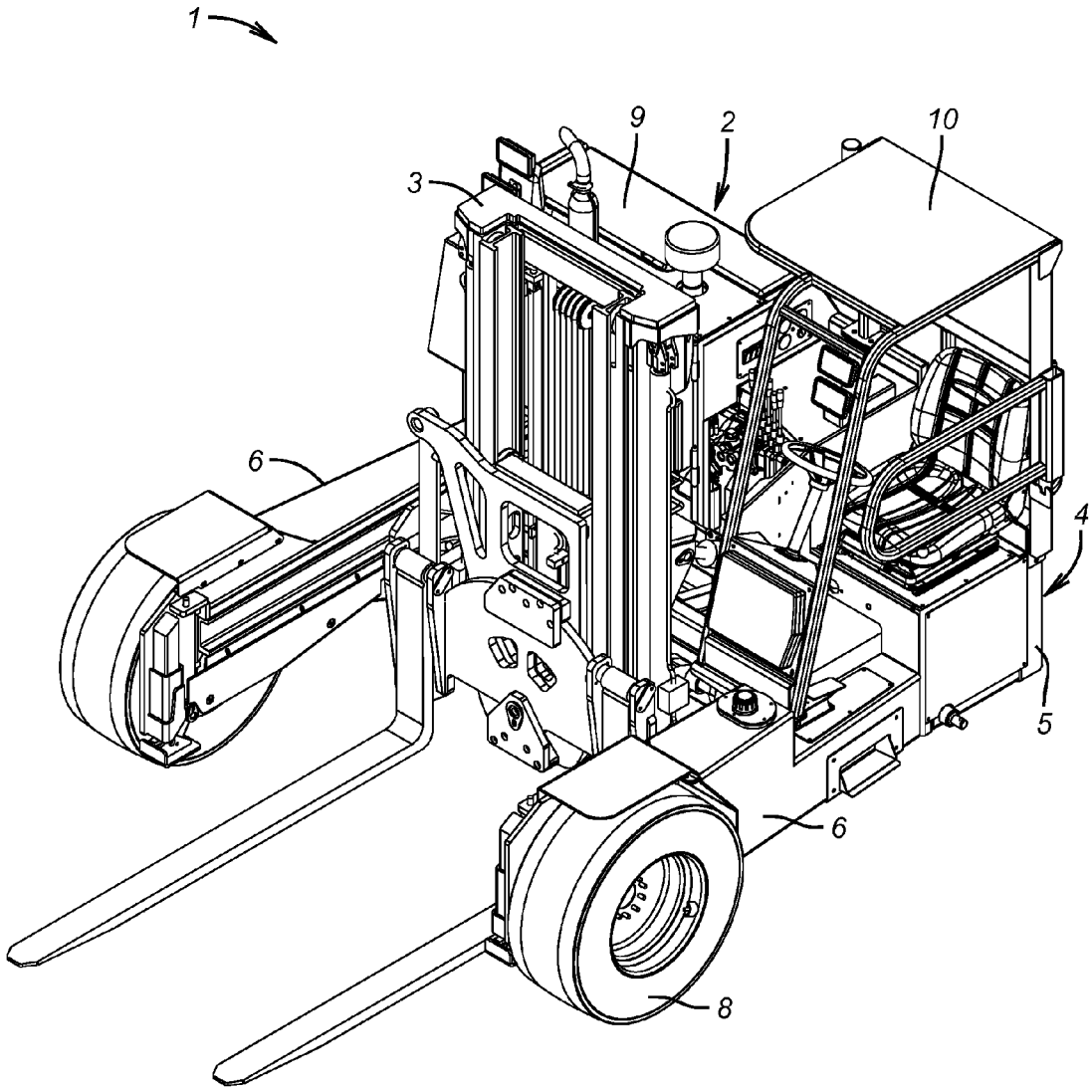
FIG. 1 is an isometric front view of a truck mountable forklift to which an exemplary embodiment of a mast assembly providing free lift and negative lift in accordance with this invention is attached.
Figure 2:
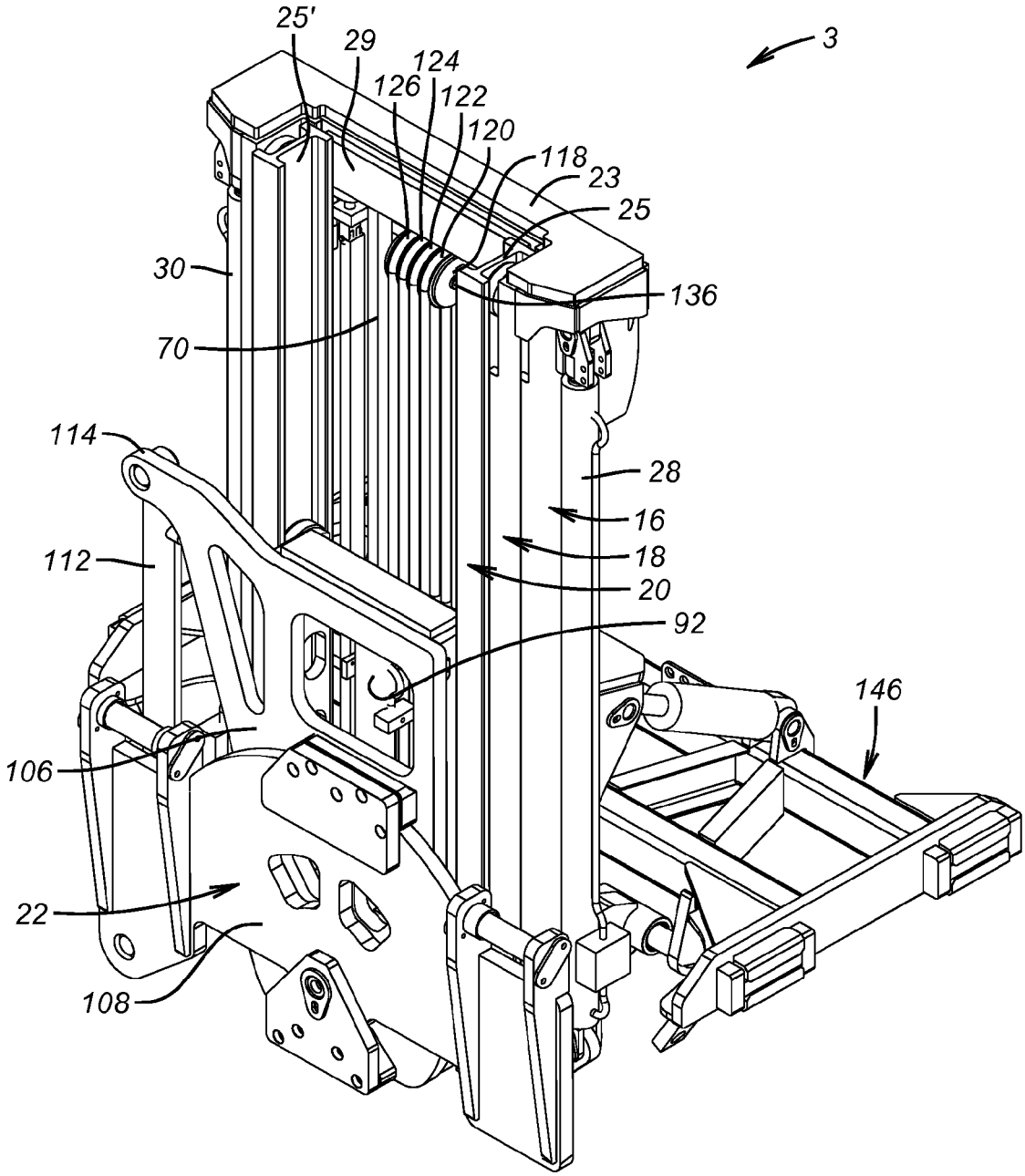
FIG. 2 is an isometric front view of an exemplary embodiment of a mast assembly in accordance with this invention.

In the following detailed description of embodiments, reference is made to the accompanying drawings, which form a part hereof and in which are shown, by way of illustration, examples of embodiments in which the invention may be practiced. In the drawings and descriptions, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. Specific details described herein, including what is stated in the Abstract, are in every case a non-limiting description and exemplification of embodiments representing concrete ways in which the concepts of the invention may be practiced. This serves to teach one skilled in the art to employ the present invention in virtually any appropriately detailed system, structure or manner consistent with those concepts. It will be seen that various changes and alternatives to the specific described embodiments and the details of those embodiments may be made within the scope of the invention. It will be appreciated that one or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

Reference throughout this specification to "an exemplary embodiment" means that a particular feature, structure, or characteristic described in connection with the embodiment is included in at least one exemplary embodiment of the present invention. Thus, the appearances of the phrase "in an exemplary embodiment" in various places throughout this specification are not necessarily all referring to the same embodiment. Furthermore, the particular features, structures, or characteristics may be combined in any suitable manner in one or more embodiments.

The term "lift" means "raise" without implication of origin of a lifting force, which may be from above or below an object lifted. The various directions such as "upper," "lower," "back," "front," "transverse," "perpendicular", "vertical", "horizontal," "length," "width," "laterally" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify.

As used herein, the use of the article "a" or "an" when used in conjunction with the term "comprising" (or the synonymous "having" or "including") in the claims and/or the specification, as, for example, in "comprising a", may mean "one," but the use is also consistent with the meaning of "one or more," "at least one," and "one or more than one."

The exemplary embodiments of the invention make use of double acting hydraulic actuators. This specific term ("double acting hydraulic actuators") is used herein for precision of explanation rather than using the more historical terms "ram" and "ram means" (a ram being understood in general to mean a pressure driven rod, but ram and ram means indiscriminately apply to single acting actuators). The double acting hydraulic actuators have a barrel or cylinder with a bore of constant diameter along the cylinder length. The cylinder is closed on each end, at a cap end and a head end. A piston travels back and forth in the cylinder and divides the inside of the cylinder in two chambers. A rod is connected to one side of the piston. The rod extends through the head end. This end of the actuator is herein called the "rod end." The rod occupies part of the chamber on the rod side of the piston and some of the surface area of the face of the piston to which the rod attaches. The end of the actuator on the side of the piston opposite the rod side is herein called the "bore end." The chamber on the bore end of the piston has more space available for fluid because no rod occupies any space in the chamber, and the surface area of the face of the bore end of the piston is larger than the face on the rod side of the piston because no part of the surface area of the face of the bore end of the piston is covered by an attached rod. The available surface area on a face of the piston (on the rod end of the piston or the bore end of the piston) herein is called the "available piston surface area", for brevity represented herein by the acronym "APSA."

The hydraulic actuators used are double acting, meaning that an orifice serving as an inlet/outlet for hydraulic fluid is provided on the rod end, and an orifice serving as an inlet/outlet for hydraulic fluid is provided on the bore end. When fluid is pressured through the inlet of the bore end, the piston is forced through the bore toward the rod end, thereby reducing the rod end chamber, expelling fluid in the chamber through the outlet of the rod end, and extending the rod from the actuator to exert linear force external to the actuator. When fluid is pressured through the inlet of the rod end, the piston is forced through the bore toward the bore end, reducing the bore end chamber, expelling fluid in the bore end chamber through the outlet of the bore end, and retracting the rod into the actuator, drawing toward the bore end whatever is attached to the end of the rod. Thus hydraulic pressure is doubly used on the actuator: (1) when introduced into the bore end, to act on the bore end face of the piston and positively extend the rod from the actuator, and (2) when introduced into the rod end to act on the rod end face of the piston, to positively retract the rod into the actuator.

In an exemplary embodiment, a double acting hydraulic actuator is positively connected between a carriage and an extensible mast member slideably mounting the carriage. An extensible mast member is a member of a mast assembly at least one member of which is extensible from a stationary or non-extensible member of the mast assembly. If only one member is extensible, the mast assembly is called a two stage mast and comprises the non-extensible or stationary member, the one extensible member, and the carriage. If a mast member is slideable on a mast member extensible from the stationary member, the mast assembly is called a three stage mast, and comprises the non-extensible member (typically an outer mast member), the extensible member slideable on the stationary member (typically a middle mast member), the additional extensible member slideable on the middle mast member (typically an inner mast member) and the carriage. There can be additional stage masts, such as four or five stage masts. A two-, three-, four- or five- (or more) stage mast is sometimes called a multi-lift mast because the carriage is always lifted on at least one extensible mast.

A carriage in the terminology of this application is not considered an extensible mast member but is a structure slideably mounted on an extensible mast member integrated as part of the multi-lift mast assembly. The carriage may be a platform carriage or a fork carriage, in either instance a carriage configured to carry a load.

As used herein, the double acting hydraulic actuator positively connected between a carriage and to an extensible mast member slideably mounting the carriage, is called, in long form, a "positively connected double acting carriage hydraulic actuator," or for brevity, a "positively connected carriage actuator," this briefer term conveniently being represented by the acronym "PCCA," but the reference always means the positively connected carriage actuator is a double acting hydraulic actuator.

As used herein, the phrase "connected to" means joined to or placed into communication with, either directly or through intermediate components. The term "positively connected," in reference to the connection of the ends of the double acting carriage hydraulic actuator to the carriage and the mast member mounting the carriage, means that the connection directly produces linear movement of the carriage responsive to linear movement of the rod of the carriage actuator, both on a rod extension and on a rod retraction, and does not interpose between the rod end and the connected carriage or extensible mast member a loosely flexible linkage such as a chain, cable, rope or other loosely flexible member as would thread over or under a pulley. A positive connection may be direct or may use intermediate connection members, and may be pivotable, for example, by a clevis on the rod end pinned to the carriage or extensible mast member to accept some linear play, but the rod extension or retraction will always drive the carriage directly, both on a rod extension and on a rod retraction. Thus, mounted right side up or upside down as described below, in an exemplary embodiment, a positively connected carriage actuator (PCCA), whether one or more, positive lifts and lowers the connected carriage, positively slidingly lifting and lowering the carriage on the extensible mast member slideably mounting the carriage.

Ordinarily in the exemplary embodiments of the invention, only a single double acting carriage actuator will be needed, but a designer may chose to use more than one, both mounted right side up or both mounted upside down in the same positively connected way, and that use is considered within the definition of the article "a" when used in conjunction with the open ended modifiers "comprising", "having" or "including", as set forth above. Thus the words "the" or "said" when used in reference to "a" positively connected double acting carriage hydraulic actuator (or the shorter renditions of this term, including the acronym PCCA) may but do not necessarily mean singularity.

In an exemplary embodiment, one end of the positively connected carriage actuator is positively connected to the extensible mast member slideably mounting the carriage and the other end is positively connected to the carriage. One of these ends is the rod of the PCCA, the other is the cylinder of the PCCA at the bore end of the PCCA. Thus, in the minimum case of a single positively connected carriage actuator, the rod of the rod end may be positively connected to the carriage and the cylinder of the PCCA at the bore end positively connected to the extensible mast member slideably mounting the carriage (a right side up configuration), or the cylinder of the PCCA at the bore end may be positively connected to the carriage and the rod of the rod end positively connected to the extensible mast member slideably mounting the carriage (an upside down configuration). If a plurality of positively connected carriage actuators (PCCAs) are elected used, two configurations are permissible: a right side up configuration in which the rods of the rod ends of the plural PCCAs all are positively connected to the carriage and the cylinders of the PCCA bore ends all are positively connected to the extensible mast member slideably mounting the carriage, or an upside down configuration in which the cylinders of the PCCA bore ends all are positively connected to the carriage and the rods of the rod ends of the plural PCCAs all are positively connected to the extensible mast member slideably mounting the carriage.

In the right side up configuration, the bore end of the PCCA is mounted on a lower portion of the mast member mounting the carriage, and the side of the PCCA piston receiving hydraulic fluid to cause lift (the "lift side") of the carriage is on the bore end. Hydraulic fluid pressing on the available piston surface area (APSA) of the bore end of the PCCA piston drives the piston toward the rod end, positively extending the rod from the cylinder to lift the carriage. Conversely, the side of the PCCA piston receiving hydraulic fluid to cause lowering of the carriage is on the rod end; hydraulic fluid pressing on the available piston surface area (APSA) of the rod end or lowering side of the PCCA piston drives the piston toward the bore end, positively retracting the rod into the cylinder to lower the carriage.

In the upside down configuration, the bore end of the PCCA is mounted on an upper portion of the mast member mounting the carriage, the rod is fully extended when the carriage is in a lowermost position, and the lift side of the PCCA piston is on the rod end. Hydraulic fluid pressing on the available piston surface area (APSA) of the rod end of the PCCA piston drives the piston toward the bore end, positively retracting the rod into the cylinder to lift the carriage. Conversely, the side of the PCCA piston receiving hydraulic fluid to cause lowering of the carriage is on the bore end; hydraulic fluid pressing on the available piston surface area (APSA) of the bore end of the PCCA piston drives the piston toward the rod end, positively extending the rod from the cylinder to lower the carriage.

In an exemplary embodiment, a positively connected double acting carriage hydraulic actuator (PCCA) is employed in an extensible mast assembly in which at least one extensible member is lifted directly by operation of other double acting hydraulic actuators. These other actuators are herein referred to as "mast lift" actuators (signified by the acronym "MLA"), because they are used in a lift system to extend (lift) one or more extensible members of the multi-lift mast. (As double acting actuators, they also positively lower the extensible mast they lift.) MLAs have the same actuator elements identified by the same terminology (piston, rod end, bore end, etc.) as the double acting carriage hydraulic actuators. A MLA extends between a stationary or non-extensible mast member and an extensible mast member for slideably moving the extensible mast member relative to the stationary mast member. MLAs may be mounted right side up or upside down, and thus there may be mast assembly embodiments in which a pair of MLAs are right side up and the PCCA is upside down or right side up, there may be mast assemblies in which a pair of MLAs are upside down and the PCCA is upside down or right side up, and there may be mast assemblies in which one MLA is upside down, the other MLA is right side up, and the PCCA is upside down or right side up In an exemplary embodiment, a three stage mast is described to illustrate use and arrangement of components in a forklift in which the concepts of the invention are employed for free lift and negative lift capabilities. In the exemplary embodiment of this three stage mast, a single PCCA is positively connected right side up between a carriage and an extensible mast member slideably mounting the carriage, and a pair of MLA's are mounted right side up between an extensible mast member and a stationary member of a three stage mast.

Figure 8:
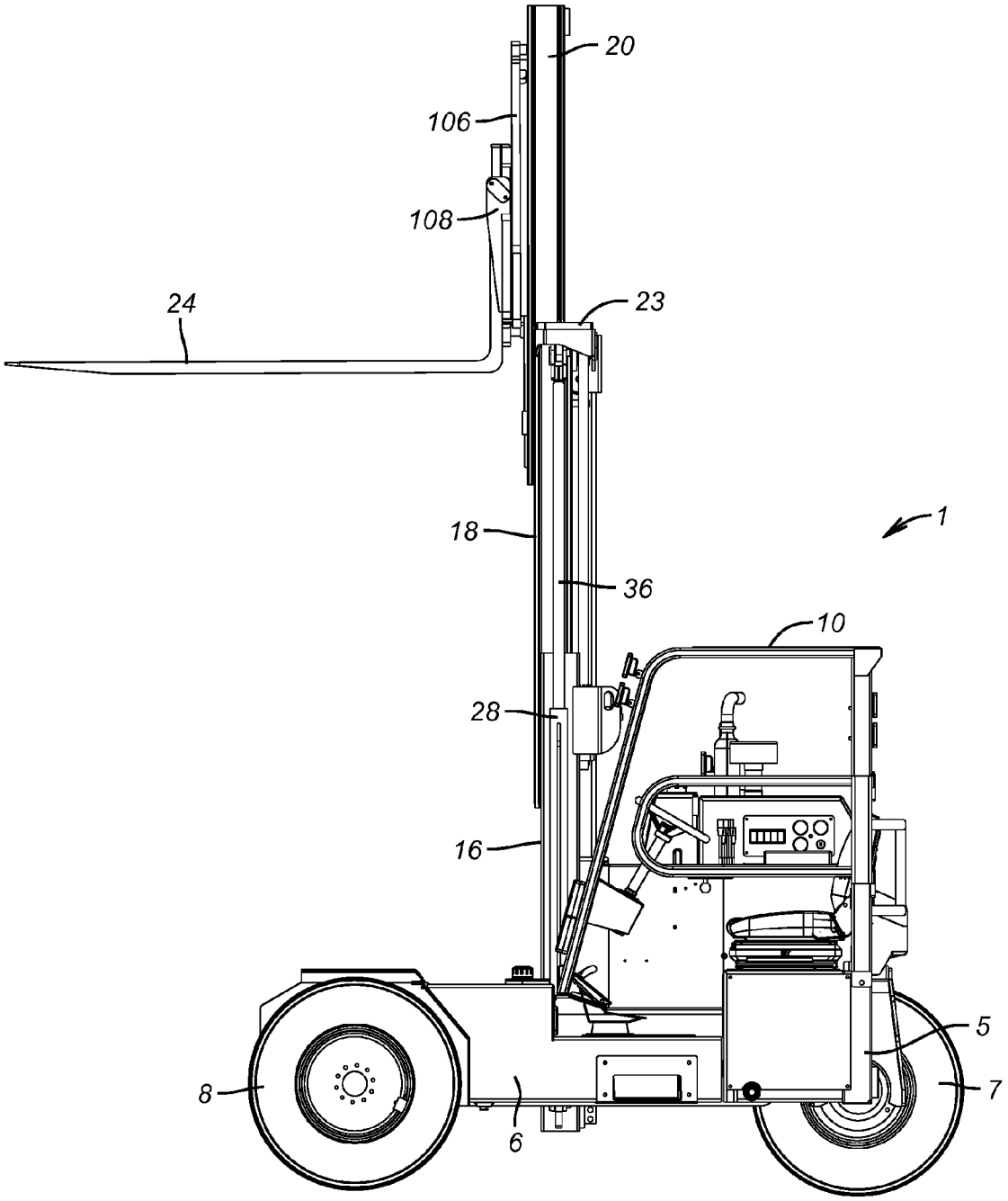
FIG. 8 is the truck mountable forklift of FIG. 1 to which the exemplary embodiment of a lift mast illustrated in FIG. 7 is attached, with the fork carriage in raised position on an inner mast with all extensible mast members including the inner mast in extended position.

Referring to FIG. 1, a forklift 1, comprising a truck 2 to which is attached a vertical multi-lift mast 3, is depicted. Truck 2 has a chassis 4 including a cross member 5 and a pair of side rails 6 extending longitudinally from cross member 5. A steerable rear wheel 7 (FIG. 8) is located centrally on cross member 5. Each side rail 6 forwardly mounts a front wheel 8. An internal combustion engine 9 for truck 2 is mounted to one side of chassis 4 and a driver's station 10 is mounted on the opposite side.

Figure 3:
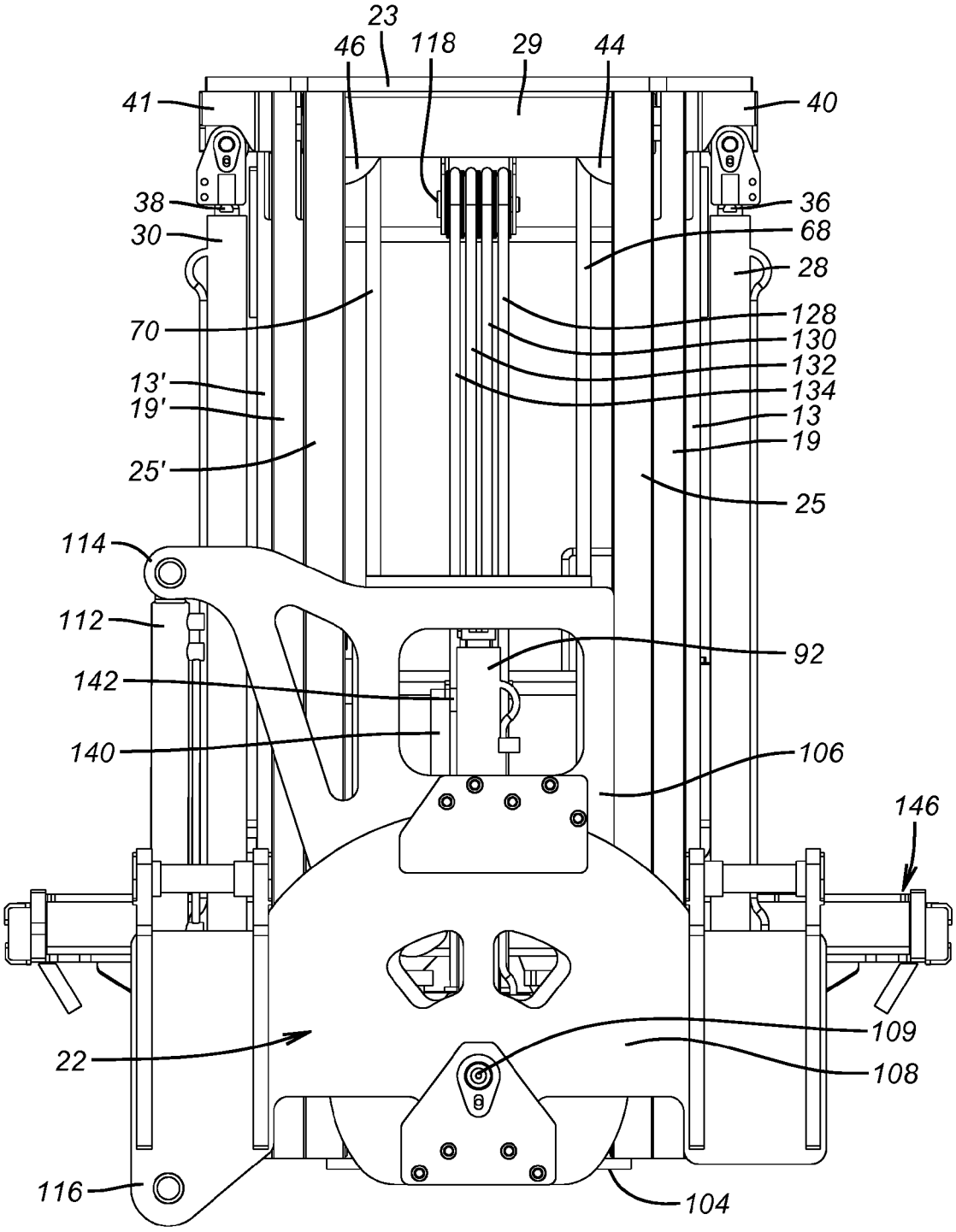
FIG. 3 is a front view of the exemplary embodiment of the mast assembly of FIG. 2.
Figure 4:
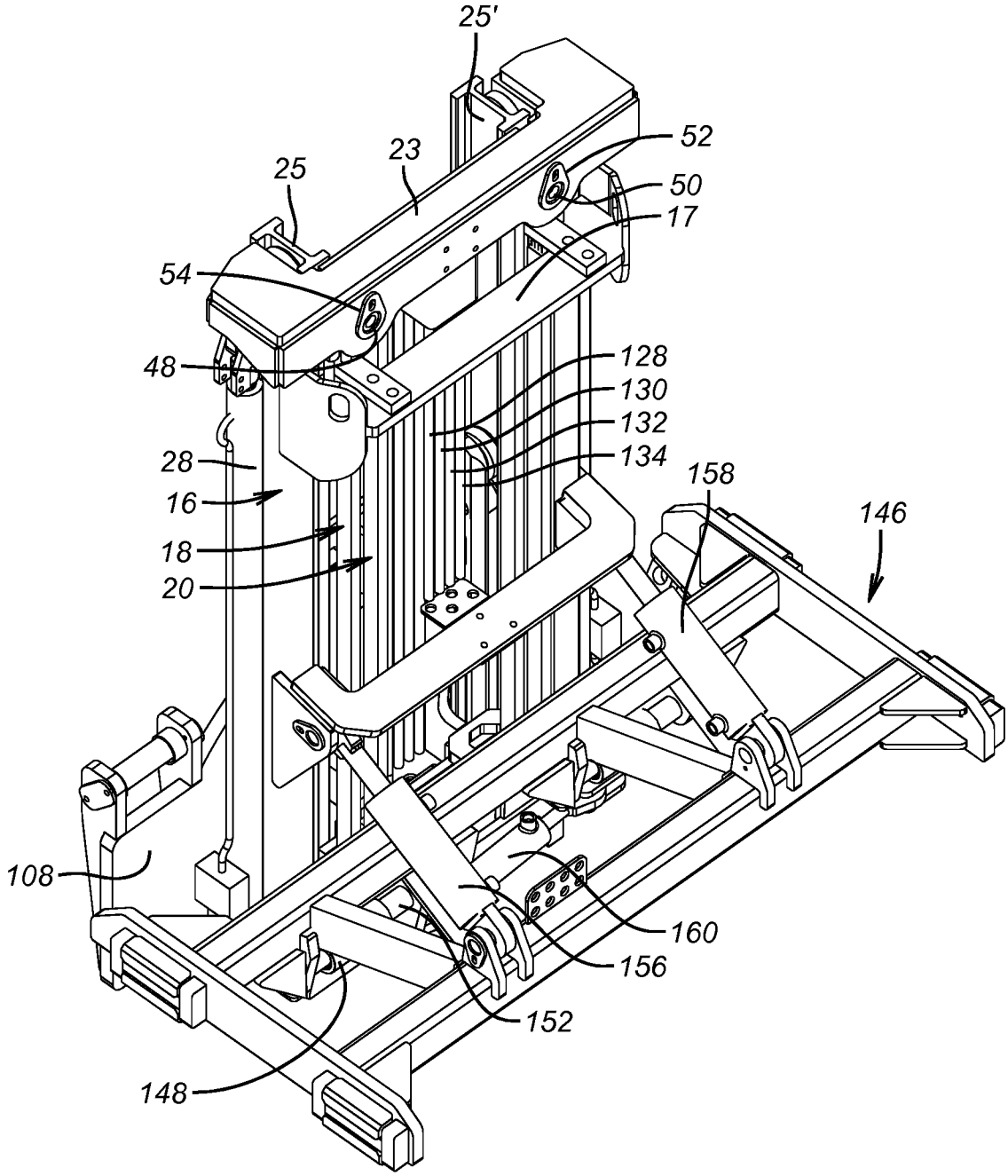
FIG. 4 is an isometric rear view of the exemplary embodiment of the mast assembly of FIG. 2.
Figure 5:
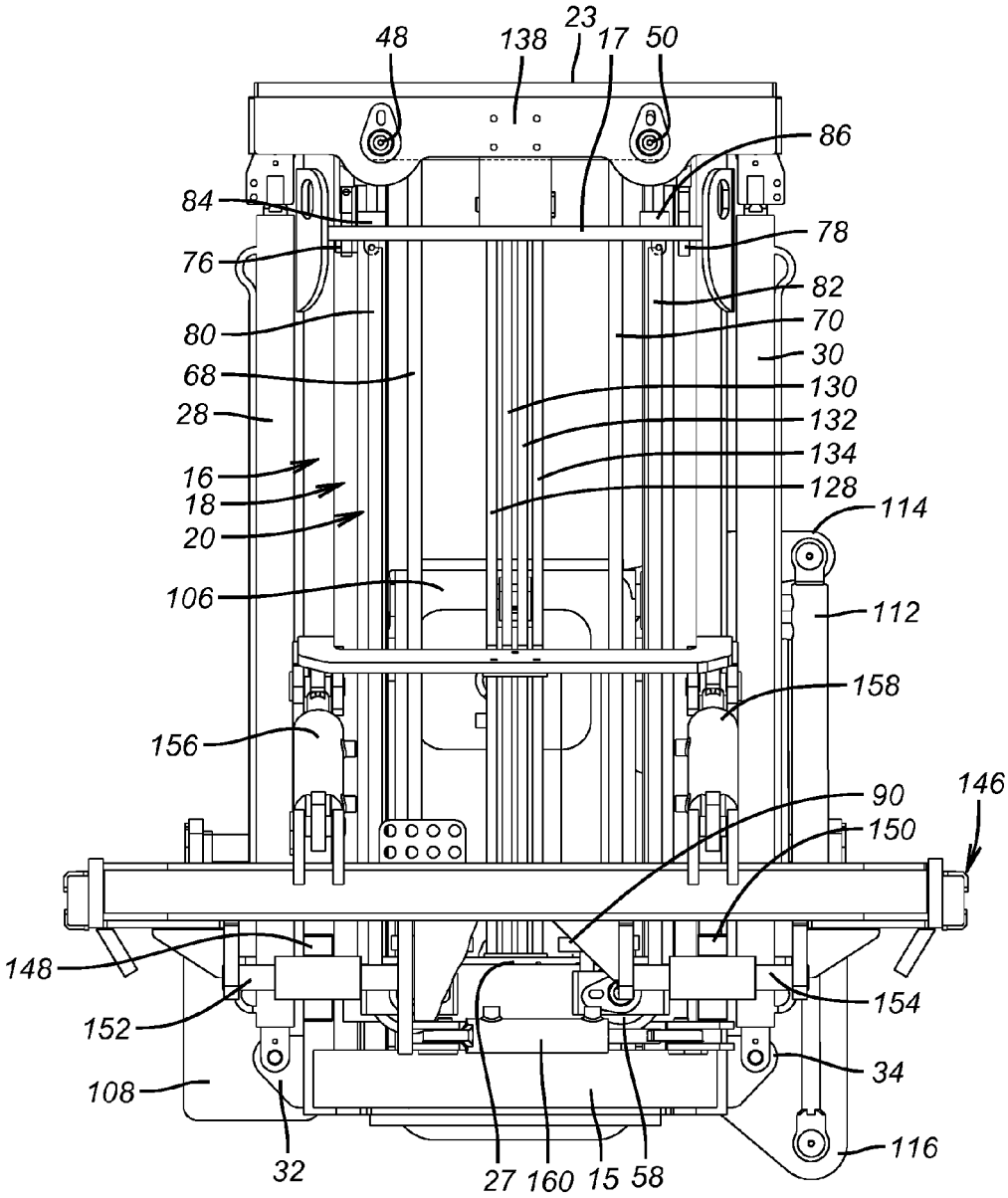
FIG. 5 is a rear view of the exemplary embodiment of the mast assembly of FIG. 2.
Figure 6:
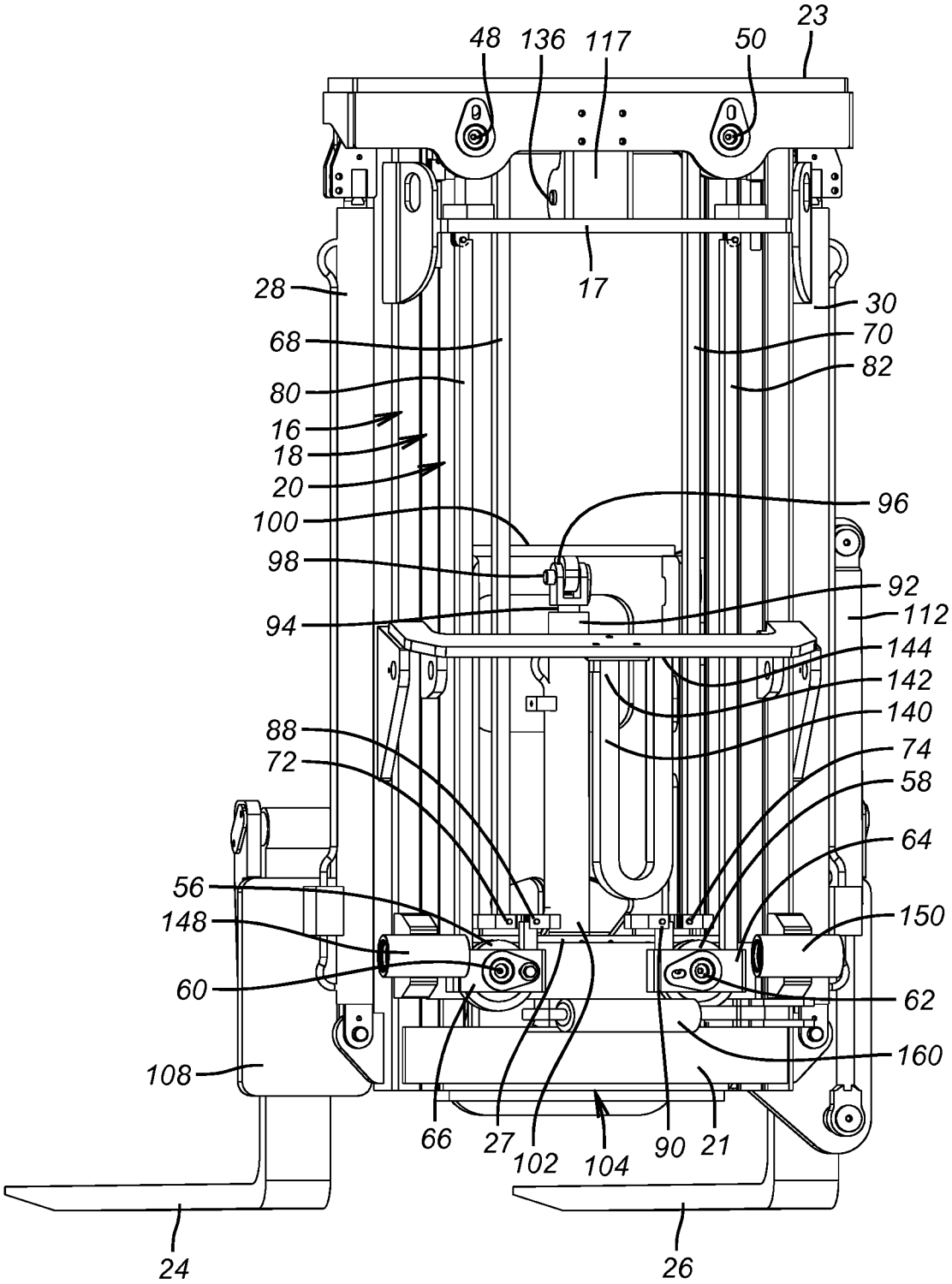
FIG. 6 is an isometric rear view of the exemplary embodiment of the mast assembly of FIG. 2 additionally including forks, with the fork carriage and extensible mast members in lowered position.
Figure 7:
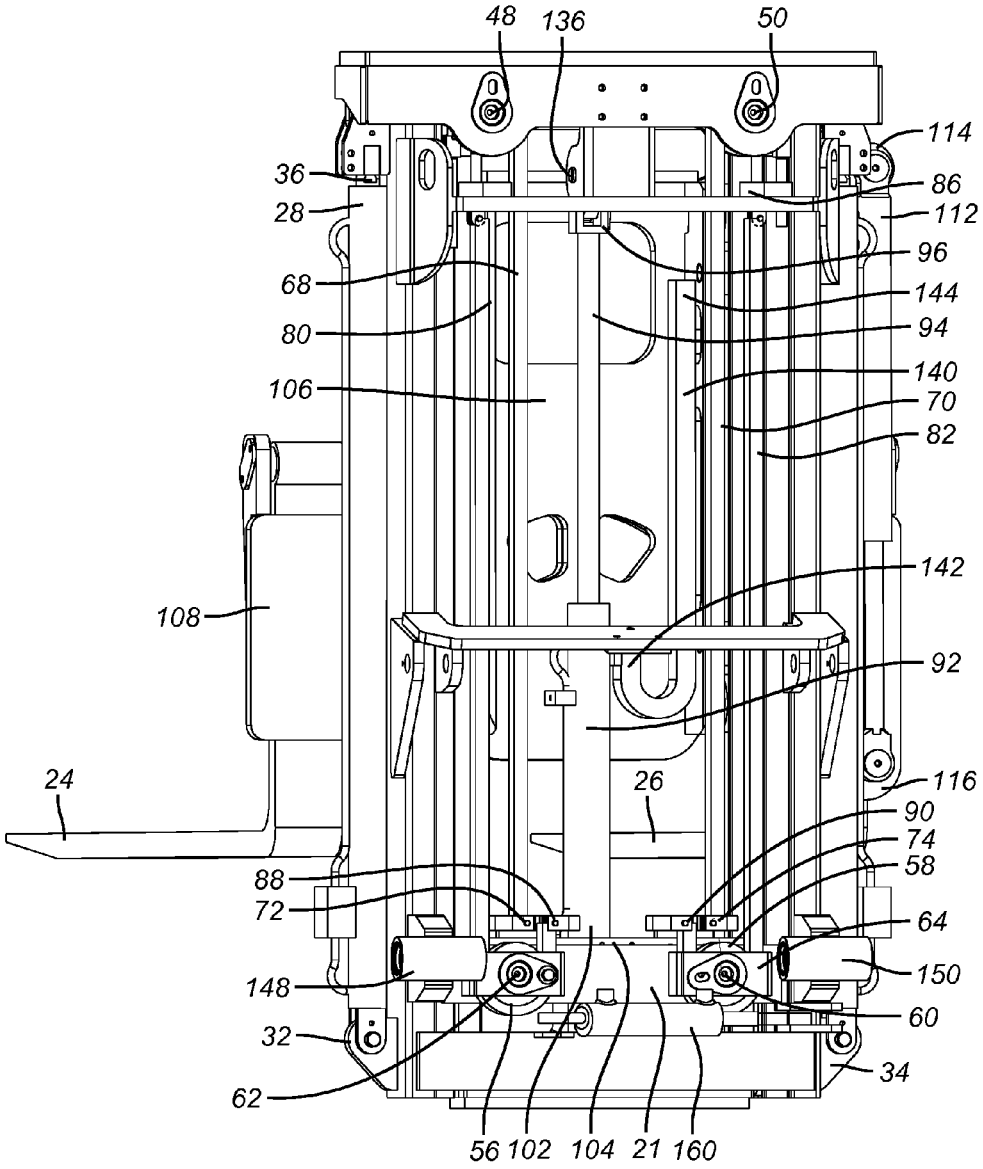
FIG. 7 is an isometric rear view of the exemplary embodiment of the mast assembly of FIG. 2 additionally including forks, with the fork carriage in raised position on an inner mast with all extensible mast members including the inner mast in lowered position.

Mast 3, here a three stage telescopic mast, is attached to truck 2. Referring to FIGS. 1-7, Mast 3 comprises an outer mast member 16, middle mast member 18 and inner mast member 20. Outer mast member 16 slidingly mounts middle mast member 18, and middle mast member 18 slidingly mounts inner mast member 20. A carriage 22 is slideably mounted to inner mast member 20. Forks 24, 26 are mounted to the carriage (FIGS. 6, 7). As best seen in FIGS. 5, 6, outer mast member 16 comprises a pair of substantially parallel uprights 13, 13' (FIG. 3) braced by a lower cross member 15 (FIG. 5) and an upper cross member 17. Middle mast member 18 comprises a pair of substantially parallel uprights 19, 19' (FIG. 3) braced by a lower cross member 21 and an upper cross member 23. Inner mast member 20 comprises a pair of substantially parallel uprights 25, 25' braced by a lower cross member 27 (FIG. 5, 6) and an upper cross member 29 (FIG. 3).

A pair of double acting hydraulic MLAs 28, 30 each extends between outer mast member 16 and middle mast member 18 for slideably moving middle mast member 18 on outer mast member 16. More particularly, each MLA 28, 30 is mounted to a lower portion, suitably lower anchors 32, 34, of outer mast member 16, and actuator rods 36, 38 respectively of actuators 28, 30 are connected to upper portions 40, 41, suitably at upper cross member 23, of middle mast member 18.

Each of a pair of spaced upper sheaves 44, 46 is mounted on an axle, respectively 48, 50, connected to upper portions 52, 54, suitably at cross member 23, of middle mast member 18. Axles 48, 50 are transverse to the width of mast 3, and accordingly the width of middle mast member 18. Each of a pair of spaced lower sheaves 56, 58 is mounted on an axle, respectively 60, 62 connected to lower portions 64, 66, suitably at cross member 21, of middle mast member 18. Axles 60, 62 are transverse to the width of the mast 3 and therefore the width of middle mast member 18.

Each of a first pair of chains 68, 70 passes over respectively upper sheaves 44, 46, and extends between respective attachment anchors 72, 74 (FIG. 6) of inner mast member 20 and respective attachment anchors 76, 78 (FIG. 5) of outer mast member 16. Each of a second pair of chains 80, 82 passes respectively under lower sheaves 56, 58 and extends between respective attachment anchors 84, 86 (FIG. 5) of outer mast member 16 and respective attachment anchors 88, 90 of inner mast member 20. The chain links ordinarily are wider than deep. The axes of pins joining links of chains 68, 70, passing around the sheaves 44,46 and the axes of the pins of chains passing around the sheaves 56, 58 are parallel to the axles of the sheaves 44, 46, 56, 58. By orienting the axles of the sheaves transversely to the width of the mast, the chains reeled over or under the sheaves present their narrowest aspect to a driver in the truck, reducing the extent of vision that is obscured when sheave axles are parallel to the width of the mast and present the width of the chain to the driver. Axles 48, 50 of upper sheaves 44, 46 are laterally outwardly horizontally offset from axles 60, 62 of lower sheaves 56, 58, for proper winding of chains 68, 70, 80, 82 around their respective sheaves.

Inner mast member 20 is constrained from movement independent of middle mast member 18 by upper chains 68, 70 and lower chains 80, 82. When mast lift hydraulic actuators 28, 30 are operated to raise rods 36, 38, upper chains 68, 70, fixed at one end to anchors 72, 74 of inner mast member 20 and passing over sheaves 44, 46 at the top of middle mast member 18, tension and raise inner mast member 20 as middle mast member rises, while at the same time, lower chains 80, 82, which are attached by anchors 84, 86 to outer mast member 16 and pass under shaves 56, 58 attaching to inner mast member 20, follow, not restraining the rise of inner mast member 20.

Conversely, when MLAs 28, 30 are operated to lower rods 36, 38 to lower middle mast member 18, lower chains 80, 82, fixed to outer mast member 16, passing under sheaves 56, 58 and attached to inner mast member 20, are tensioned, pulling down inner mast member 20 as middle mast member 18 lowers, and at the same time, upper chains 68, 70, fixed at one end to anchors 72, 74 of inner mast member 20 and passing over sheaves 44, 46 at the top of middle mast member 18, follow, not restraining the lowering of inner mast member 20.

As best seen in FIGS. 5, 6, a PCCA 92 has a rod 94 the clevis end 96 of which is positively connected by a pin 98 to an upper portion 100 of carriage 22. A bore end 102 of PCCA 92 is positively connected to a lower portion 104 of inner mast member 20. This arrangement positively slidingly lifts and lowers carriage 22 on inner mast member 20 without lifting middle and inner mast members 18, 20, respectively, when rod end 96 is extended and retracted. Suitably, the APSA of PCCA 92 on the side of the piston receiving hydraulic fluid to cause carriage lift (in the depicted orientation, the bore end 102) is larger than the APSA of the side of each piston of the MLAs 28, 30 receiving hydraulic fluid (in the depicted orientation, the bore ends 103, 105) to cause lift of mast 3 and its associated structure, including sheaves 44, 46, 56, 58 and chains 68, 70, 80, 82.

Carriage 22 comprises an inner section 106 slideably moveable on inner mast member 20 and an outer section 108 mounted for axial rotational movement on a pin 109 affixed to inner section 106. A rotator double acting hydraulic actuator 112 extends between an upper arm portion 114 of inner carriage section 106 and a lower lateral portion 116 of outer section 108 for pivoting outer section 108 on inner section 106.

A hose roller 118 comprises a plurality of grooves 120, 122, 124, 126 (FIG. 2) for hydraulic hoses 128, 130, 132, 134 (FIG. 3). Hydraulic hoses 128, 130 are the lift and retract fluid pressure hoses for PCCA 92, and hoses 132, 134 are the clockwise and counter clockwise rotational direction pressure hoses for double acting rotator hydraulic actuator 112.

Hose roller 118 is rotatable on an axle 136 connected by support 117 to a central upper portion 138 of middle mast member 18 transverse to the axles 48, 50 of upper sheaves 44,46. Hydraulic hoses 128, 130 pass over grooves 120, 122 of hose roller 118 for movement with PCCA 92 on raising and lowering of inner mast member 20 on middle mast member 18. Hydraulic hoses 132, 134 pass over grooves 124, 126 of hose roller 118 for movement of carriage 22 on raising and lowering of inner mast member 20. A flexible hydraulic hose sheath 140 has one end 142 connected to PCCA 92 and the other end 144 connected to inner section 106 of carriage 22, for shieldingly enclosing hydraulic hoses 132, 134 for rotator hydraulic actuator 112 during movement of carriage 22 on inner mast member 20.

A frame 146 is attachable to forklift truck 2 for horizontally hinging mast 3 to frame 146. Frame 146 mounts pivot ears 148, 150 of outer mast member to pins 152, 154 mounted to frame 146. A tilter double acting hydraulic actuator 156 (two are shown, so 156, 158) extends between frame 146 and mast 3 for horizontally pivoting mast 3 relative to frame 146 (tilting forward, to drop tips of forks 24, 26; tilting backward to raise tips of forks 24, 26).

A sideshift double acting hydraulic actuator 160 extends horizontally between a portion of the frame 146 and mast 3, for slideably moving mast 3 horizontally relative to frame 146. A hydraulic actuator (not shown) slides mast 3 forward and back on side rails 6.

In a three stage mast of the type described in U.S. Pat. No. 5,328,321, a cascade of two pulley sets is used to lift and lower a carriage. The carriage is lifted and lowered on the inner mast by chains between the carriage and the middle mast pulleyed on the inner mast member. The inner mast member is lifted on the middle mast member by a pair of chains (one on each side of the inner mast) attached at one end to the outer mast member and pulleyed on the middle mast member, and is lowered on the middle mast by another pair of chains (one on each side of the inner mast) attached at one end to the outer mast member and pulleyed on the middle mast member. Each chain of the pulleyed pair of chains for raising the inner mast bears the same load as the chain between the middle mast member and the carriage for raising the carriage and half the weight of the middle mast. Therefore the rams lifting the middle mast member must raise in addition to the weight of the middle mast triple the weight of the carriage and its workload. In the exemplary embodiments of FIGS. 1-8, the chains 68, 70 over sheaves 44, 46 carry half the load of the chains between the outer mast and the inner mast in the mast assembly of U.S. Pat. No. 5,328,321, because the PCCA 92 eliminates the cascade of pulley sets employed in U.S. Pat. No. 5,328,321. In addition to the benefits of free lift and negative lift provided by exemplary embodiments described herein, smaller MLAs may be used because less weight needs to be lifted compared to the design in U.S. Pat. No. 5,328,321.

The exemplary embodiment of FIGS. 1-8 has free lift and negative lift capabilities. Free lift actuates PCCA 92 before actuating MLAs 28, 30, causing carriage 22 to be lifted without lifting extensible middle and inner mast members 18, 20. Negative lift begins with carriage 22 elevated and fixed against an immovable object, not allowing carriage 22 to move down inner mast member 20 on which carriage 22 is slideably mounted. So positioned and fixed, when PCCA 92 is operated as if to lower carriage 22, inner mast member 20 to which PCCA 92 is attached is drawn upwardly relative to fixed carriage 22, lifting forklift 1.

Free lift and negative lift are provided by properly sequencing the raising and lowering of extensible middle mast member 18 directly raised and lowered by the MLAs 28, 30 (and simultaneous lift of extensible inner mast member 20 indirectly lifted because linked to movement of directly lifted middle member 18) relative to raising and lowering of carriage 22 by PCCA 92. For free lift, proper sequencing raises carriage 22 from a lowermost position or any position up to maximum elevation, relative to the extensible mast member on which it moves (inner mast member 20), without raising an extensible mast member or members (middle mast member 18 and inner mast member 20). Proper sequencing of an extended multi-lift mast first lowers the extensible mast members 18, 20 and then lowers carriage 22. For negative lift, proper sequencing prevents the extensible mast members 18, 20 from rising when hydraulic pressure is applied as if to lower fixed carriage 22. This allows lift of the forklift attached by the extensible mast members to carriage 22 without extending the extensible masts.

In general, in hydraulic circuits with more than one actuator, the actuator requiring the least pressure to move its load extends first. At the end of its stroke, system pressure increases and extends the second actuator. The weight of structure connected to the piston rod of the piston of the actuator is always a part of the load, and additional load will result if the carriage carries a workload. Less pressure will be required to lift a lighter load, and less pressure will be required for a piston having a larger APSA on the bore end of the piston (force in a direction perpendicular to the surface of an object is pressure applied to the object surface multiplied by the area of the surface).

In a multi-lift mast assembly the MLAs have to lift the weight of every extensible mast member and all elements carried by every extensible mast member, which includes the fork carriage, and when the carriage is loaded, its workload. For free lift, a PCCA moves only the fork carriage and any workload, and thus will have less weight to lift. Thus in simple theory, for a PCCA piston having about the same APSA as each MLA, the PCCA will require less hydraulic pressure to lift the carriage than the pressure necessary for the MLAs to lift the extensible mast members and associated structure, and the lesser hydraulic pressure sufficient to lift the carriage inclusive of any carried workload will be insufficient to power the MLA to lift the extensible mast members and the fork carriage mounted on an extensible mast member inclusive of the carriage and any workload carried by the carriage. Thus, the number of extensible mast members is relevant to APSA sizing of the pistons of the PCCA and the MLAs for a given lifting pressure applied to the piston of the PCCA.

In the simplest case and an exemplary embodiment of a two stage mast comprising a single extensible mast member lifted by MLAs and a carriage mounted on that single extensible member, the single extensible mast member has no supplemental motive means such as chains, guides and other paraphernalia associated with a pulleyed chain lift extensible mast member. In this instance, assuming two MLAs and a substantially equal weight for the single extensible mast member and the carriage inclusive of its workload rating, in simple theory the APSA of the PCCA piston on the lift side of the piston (the side receiving hydraulic fluid to cause carriage lift) in an exemplary embodiment inclusive of a hydraulic circuit as herein described is at least about equal the sum of the APSAs of the lift sides of the pistons of the MLAs (the sides receiving hydraulic fluid to cause extensible mast lift). (Another way of saying this is that the APSA on the lift side of the PCCA piston is at least about twice as large as the APSA of the lift side of each piston of the MLAs, or conversely, that the APSA on the lift side of each MLA piston is no more than about half the APSA of the lift side of the PCCA piston.)

In a multi-lift mast of a single or more extensible mast member, the size of the APSA of the lift side of the pistons of the MLAs relative to the size of the APSA of the lift side of the pistons of the PCCA may be generally expressed by the following relationship:

Total APSA of MLA(s) is about equal or less than (= or <) Total APSA of PCCA(s)×n, where n=the number of extensible masts.

The equivalent statement is:

Total APSA of PCCA(s) is about equal or greater than (= or >) Total APSA of MLA(s)/n, where n=the number of extensible masts.

Thus for an APSA of the PCCA piston=1, for a two stage mast (one extensible mast member), the total APSA for 2 MLAs=1×1=1. The APSA of the lift side of each MLA piston=½. Or conversely, for 2 MLAs, if for example the total APSA of the 2 MLAs is 8 $in^2$ (each is 4 $in^2$), there being a single extensible mast, the total APSA of the PCCA piston 8 $in^2$/1 is = or >8 $in^2$.

For an APSA of the PCCA piston=1, for a three stage mast (two extensible mast members), the total APSA for 2 MLAs=1×2=2. The APSA of the lift side of each MLA piston=1. Or conversely, for 2 MLAs, if for example the total APSA of the 2 MLAs is 8 $in^2$ (each is 4 $in^2$), there being two extensible masts, the total APSA of the PCCA piston 8 $in^2$/2 is = or >4 $in^2$.

For an APSA of the PCCA piston=1, for a four stage mast (three extensible mast members), the total APSA for 2 MLAs=1×3=3. The APSA of the lift side of each MLA piston=1.5. Or conversely, for 2 MLAs, if for example the total APSA of the 2 MLAs is 8 $in^2$ (each is 4 $in^2$), there being three extensible masts, the total APSA of the PCCA piston 8 $in^2$/3 is = or >2.67 $in^2$.

For an APSA of the PCCA piston=1, for a five stage mast (four extensible mast members), the total APSA for 2 MLAs=1×4=4. The APSA of the lift side of each MLA piston=2. Or conversely, for 2 MLAs, if for example the total APSA of the 2 MLAs is 8 $in^2$ (each is 4 $in^2$), there being four extensible masts, the total APSA of the PCCA piston 8 $in^2$/4 is = or >2 $in^2$.

Thus, in an exemplary embodiment, in a three stage mast (two extensible mast members, one a MLA lifted mast member, the other a member lifted by a pulleyed chain pair) the APSA on the lift side of the piston of each MLA in simple theory is about twice the size of the APSA on the lift side of the piston of each MLA for the two stage mast, assuming the same pressure applied to lift the PCCA in a two stage mast. Since the APSA on the lift side of each MLA piston for a two stage mast is about half the APSA of the lift side of the PCCA piston for the two stage mast, then the APSA on the lift side of each MLA piston for the three stage mast is about the same size of the APSA of the lift side of the PCCA piston for the two stage mast. In an exemplary embodiment employing a pair of MLAs in addition to a single PCCA in a three stage multi-lift mast, the APSA on the lift side of the PCCA piston is at least about as large as the APSA of the lift side of each piston of the MLAs. In an exemplary embodiment employing more than one PCCA in a three stage mast, the total APSA of the pistons of the PCCAs on the lift side of the piston is at least about as large as the APSA of the lift side of each piston of the MLAs.

For a four stage mast (three extensible mast members, one a MLA lifted mast member, the two other members lifted by supplemental motive means, e.g., pulleyed chains) in an exemplary embodiment, the APSA of each of the lift sides of the pistons of the MLAs is at least about 1.5 the size of the APSA for the lift side of the piston of the PCCA. In an exemplary embodiment employing more than one PCCA in a four stage mast, the total APSA of the pistons of the MLAs on the lift side of the piston is at least about 1.5 times as large as the total APSA of the lift side of the piston of the PCCAs.

In the preceding discussion on relative sizing of the APSAs of the MLAs and the PCCA, the expression "equal or less than (= or <)" or the expression "equal or greater than (= or >)" (or the equivalent "at least" or "equal or exceeding") are simple approximations qualified by "about", recognizing that engineering a particular mast embodying the concepts of this invention must take into account the relative loads imposed by the weights of the mast members and the carriage and carriage workload rating, which will vary from one design to another, so the relationship cannot be stated with exactitude. The "at least" in the modifying phrase "at least about" signifies that the rough ratio approximates the least sizing for the APSA for the lift side of the PCCA controlled in a hydraulic circuit as hereinafter described. Better results ordinarily will be realized using a larger APSA for the lift side of the PCCA than established for the base case of where the APSA of the bore side of pistons of the MLAs is proportioned from the APSA of the bore side of the PCCA piston effective to lift the carriage and its workload in a two stage mast. As a practical matter, if the APSA of the PCCA is not sufficiently large relative to the APSA of each of the MLAs, the extensible mast member may lift with the carriage. This potentiality may occur at high fluid flow as when the hydraulic pump is operated at too high a speed or hydraulic hoses to the actuators are undersized or pinched, resulting in an increase in pressure in the lines that feed the actuators, causing the extensible mast members to rise when not desired. Accordingly, in the exemplary embodiment of FIGS. 1-8, the APSA of a piston on the lift side of PCCA 92 is larger than the APSA of the pistons on the lift side of either of the MLAs to give greater assurance the fork carriage will rise before the extensible mast members. As an example, in a three stage mast assembly as in FIGS. 1-8, the APSA on the lift side of the piston in the PCCA suitably may be 4.9 $in^2$ and the APSA on the lift side of each piston in the MLAs suitably may be 4.0 $in^2$.

While simple in concept, sizing the relative actuators and hoses for sequencing carriage lift before extensible mast member lift to provide total free lift is not alone enough to provide both free lift and negative lift. In an exemplary embodiment, a hydraulic circuit hereinafter described is provided for PCCAs and MLAs having APSA properly sized on the bore side of the actuator pistons so the PCCA requires the least pressure to move its load, to assure the carriage is always fully lifted before the extensible mast member or members of the multi-lift mast assembly are extended. The hydraulic circuit is organized to assure that the MLAs do not elevate the mast lift rods until a MLA threshold pressure is attained in predetermined excess of the pressure effective to free lift the positively connected carriage.

The hydraulic circuit in the exemplary embodiment also provides negative lift, for example, to piggyback the forklift to which the mast is attached In an exemplary embodiment, proper sequencing of the operations of the PCCA and the MLAs is provided by a hydraulic circuit that prevents the extensible mast on which the free lift carriage is mounted from elevating when the PCCA is operated as if to lower the carriage after the forks of the carriage are fixed by insertion into fork receivers on a hauling vehicle.

In an exemplary embodiment, the hydraulic circuit that assures free lift and provides negative lift comprises first and second hydraulic pressure supply lines for the mast lift and carriage actuators and a pair of pilot operated normally closed valves for sequencing each actuator. One valve of the pair fluidly communicates with an orifice at one end of an actuator and the first supply line, and the other valve of the pair fluidly communicates with an orifice at the other end of the same actuator and the second supply line. Each valve has an operator piloted by a supply line pressure and is operative at a predetermined pressure to release fluid from the orifice with which it communicates. The valve fluidly communicating with the orifice at the one end of the actuator has an operator piloted by pressure in the second supply line to the other end of the same actuator, and the valve fluidly communicating with an orifice at the other end of same actuator has an operator piloted by pressure in the first supply line to the one end of the same actuator. The operator of the valve for the one end of the positively connected carriage actuator operates at greater pressure than the operator of the valve for the other end of the carriage actuator, and the operator of the one end of each of the mast lift actuators operates at lesser pressure than the operator of the valve for the other end of the same mast lift actuator.

In an exemplary embodiment, the hydraulic circuit has paired first and second 4-branch cross circuits for each actuator. The first 4-branch cross circuit for each actuator fluidly communicates with one end of the actuator for regulating said one end of the actuator, and the second 4-branch cross circuit for each actuator fluidly communicates with the other end of the actuator for regulating such other end of the actuator. The first supply line is in fluid communication with the first 4-branch cross circuit for the positively connected carriage actuator and the first 4-branch cross circuit for the mast lift actuators, and the second supply line is in fluid communication with the second 4-branch cross circuit for the positively connected carriage actuator and the second 4-branch cross circuit for the mast lift actuators. Each 4-branch cross circuit comprises a first branch in fluid communication with said supply source of fluid pressure, and second, third and fourth branches in fluid communication with the first branch. The second branch is in fluid communication with a normally closed 3-port valve through a first of the three ports. The second port fluidly communicates with an orifice at the end of the actuator regulated by the cross circuit. The 3-port valve has a piloted operator for connecting the first and second ports to the second branch on operation of the operator, and an adjustable pressure setting spring for maintaining the valve closed until attainment of a pressure operative on the operator exceeding the pressure setting. The third branch of the 4-branch cross circuit is in fluid communication through a check valve to (i) a primary branch in fluid communication with an end of the actuator, (ii) a secondary branch in fluid communication with the second port and the orifice at the end of the actuator regulated by the cross circuit, and (iii) a tertiary branch in fluid communication with the third port for internally piloting opening of the valve on attainment of a pressure at the orifice at the end of the actuator regulated by the cross circuit in excess of a predetermined pilot ratio for said piloted operator. The fourth branch of the 4-branch cross circuit is in piloting fluid communication with the operator of the 3-port valve of the other of the two 4-branch cross circuits.

In an exemplary embodiment, the hydraulic circuit includes a check valve in parallel with each pilot operated normally closed valve for feeding supply line pressure to the orifice with which the valve is in fluid communication and for checking flow from the orifice when the pilot operated valve is closed and supply line pressure is ceased.

In an exemplary embodiment, the hydraulic circuit for the actuators comprises first and second hydraulic pressure supply lines and a plurality of paired counterbalanced valves, one pair for each actuator, for sequencing the actuators. The pairs are operatively connected to the supply lines and to the actuators. One valve of each pair is operatively connected to the bore end of an actuator and the other is operatively connected to the rod end of the same actuator. The counterbalance valves operate (i) in response to supply of a first fluid pressure in the first pressure supply line to first operate the paired pressure relief valves for the positively connected carriage actuator to relieve pressure from the rod end of the carriage actuator and raise the carriage on the extensible mast member mounting the carriage to full extension, and in response to a second fluid pressure in the first supply line exceeding the first fluid pressure, then to operate the paired pressure relief valves for the mast lift actuators to relieve pressure from the rod end of the mast lift actuators and raise an extensible mast member, and (ii) in response to supply of a first fluid pressure in the second pressure supply line to first operate the paired pressure relief valves for the mast lift actuators to relieve pressure from the bore end of the mast lift actuators and lower the extensible mast member fully, and in response to a second fluid pressure in the second supply line exceeding the first fluid pressure in the same line, then to operate the paired pressure relief valves for the positively connected carriage actuator to relieve pressure from the bore end of the carriage actuator and lower the carriage on the extensible mast member mounting the carriage, the valves preventing the mast lift actuators from raising an extensible mast member when the positively connected carriage actuator is operated to lower the carriage.

Figure 9:
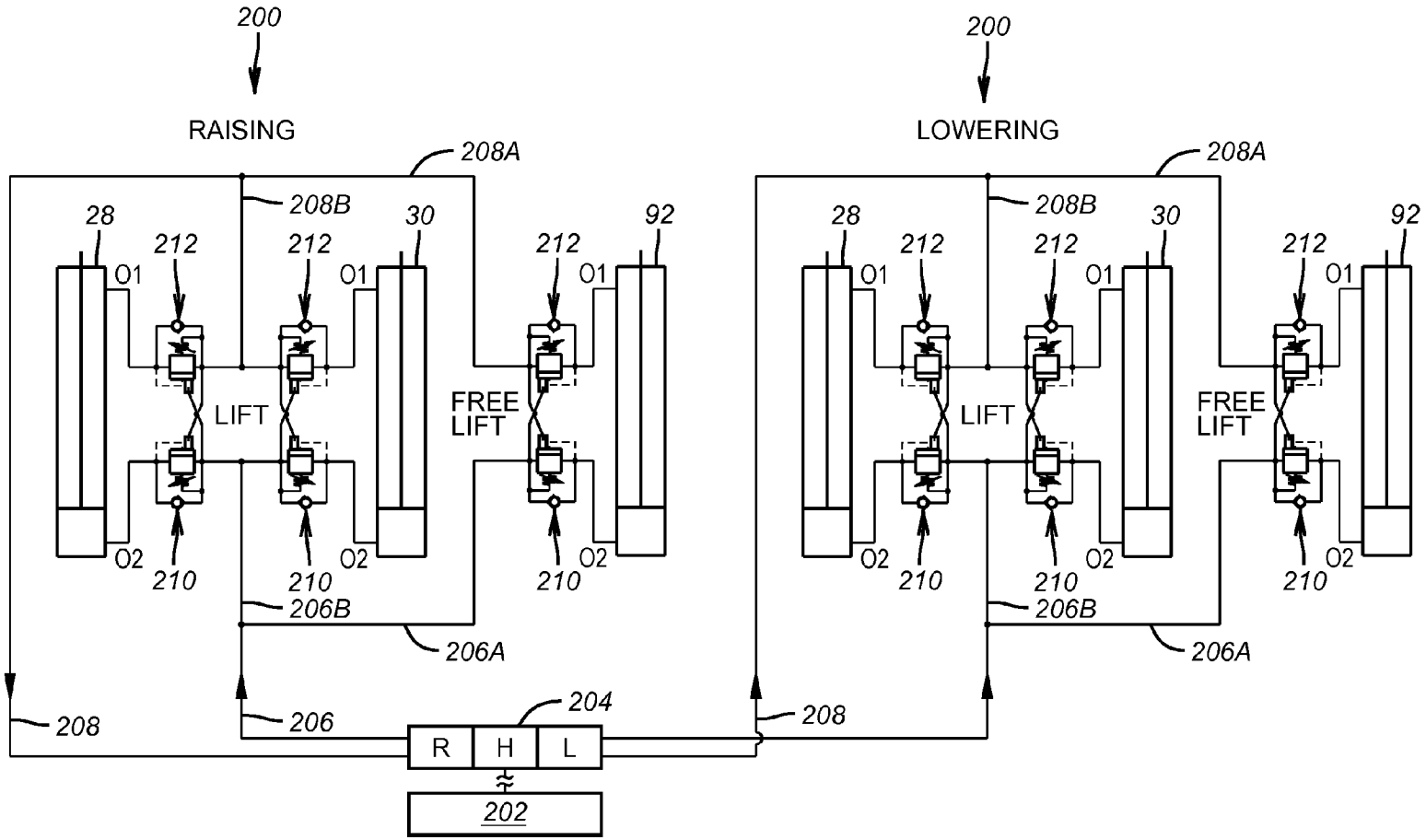
FIG. 9 is a flow schematic of a portion of a hydraulic circuit for proper sequential operation of the actuators of the mast assembly of FIG. 2.
Figure 10A:
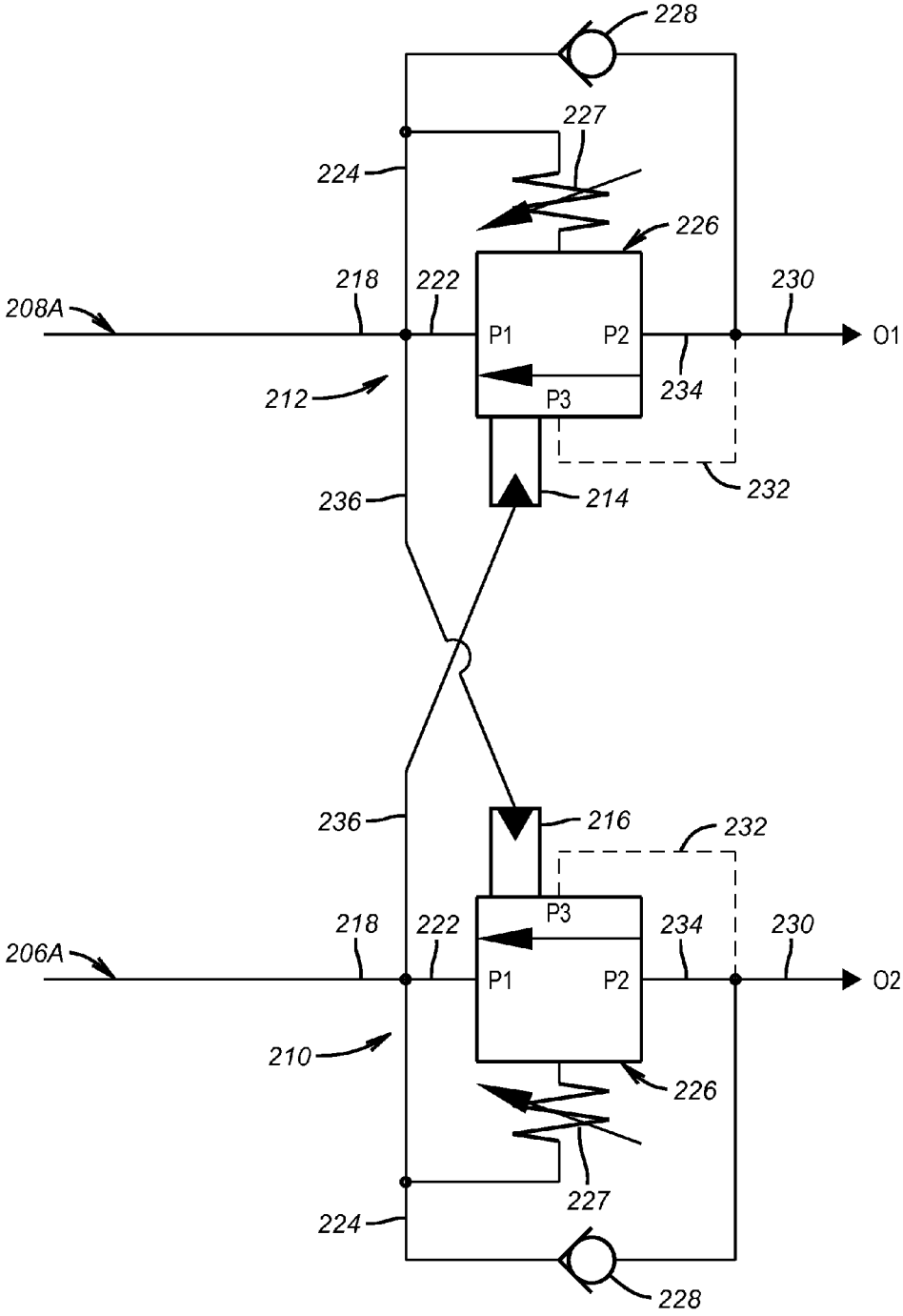
FIG. 10A is an enlargement of the first and second sequencing valves for the carriage actuator in the circuit of FIG. 9.
Figure 10B:
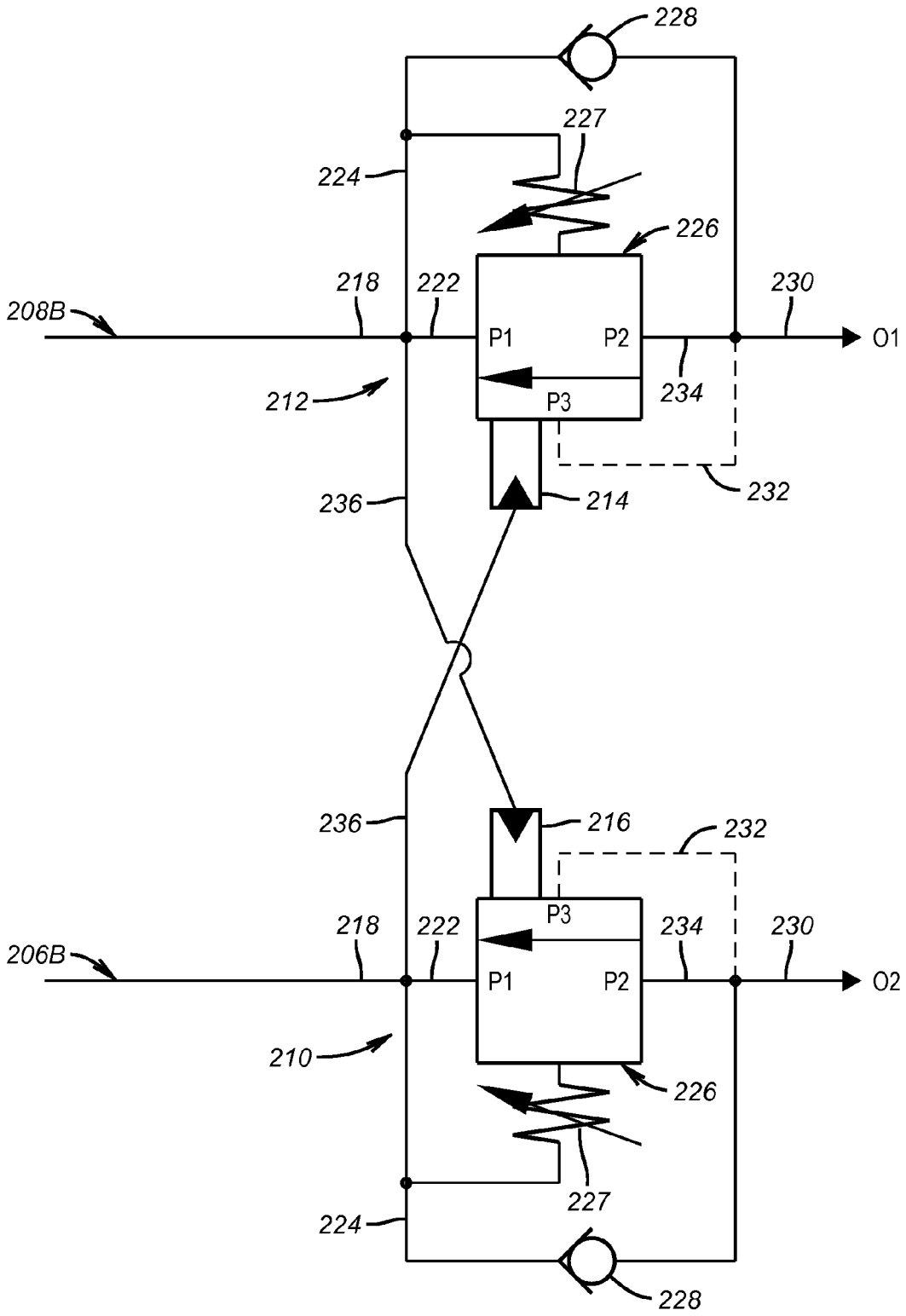
FIG. 10B is an enlargement of the first and second sequencing valves for the mast lift actuators in the circuit of FIG. 9

More particularly, with reference to FIGS. 9, 10A and 10B, a hydraulic circuit 200 controls the sequence of operation of the PCCA 92 and the MLAs 28, 30 to provide negative lift and to assure free lift. In FIGS. 9, 10A and 10B, the same right side up configuration for the actuators as in the exemplary embodiment described in FIGS. 1-8 is described, and in this exemplary embodiment, extension of an actuator rod raises the structure to which the rod end is attached, and retraction of the rod lowers the structure. As explained above, this is merely illustrative. In an upside down arrangement, a fully extended rod can be retracted to lift the structure to which it is attached, and extended to lower the structure. The description of the right side up hydraulic circuitry will inform application for the upside down variations.

Referring to FIGS. 9, 10A and 10B, in an exemplary embodiment, a hydraulic circuit 200 for MLAs 28, 30 and PCCA 92 comprises a source 202 of pressure fluid, a control valve 204 having raise (R), hold (H) and lower (L) positions, and first and second pressure supply lines, respectively 206 and 208. Line 206 branches into lines 206A and 206B. Lines 206 A and 206B supply the bore ends of PPCA 92 and MLAs 28,30 respectively. Line 208 branches into lines 208A and 208B. Lines 208A and 208B supply the rod ends of PCCA 92 and MLAs 28, 30 respectively. FIG. 10A illustrates lines 206A and 208A supplying PCCA 92. FIG. 10B illustrates lines 206B and 208B supplying one of the MLAs 28, 30 (the supply is identical for both MLAs). In FIG. 9, the left portion of the drawing shows the directions of fluid flow for raising carriage 22 and the extensible mast members 18, 20, and the right portion of the drawing shows the directions of fluid flow for lowering carriage 22 and extensible mast members 18, 20.

Sequencing counterbalance valves 210, 212 are provided for operating MLAs 28, 30 and PCCA 92 such that supply of fluid pressure in the first pressure supply line 206 (control valve 204 in raise position R) first extends rod 94 of PCCA 92 to raise carriage 22 on innermost mast member 20 and then extends rods 36, 38 of MLAs 28, to raise the vertically slideable mast members 18, 20, and such that supply of fluid pressure in the second pressure supply line 208 (control valve 204 moved to lower position L) first retracts rods 36, 38 of MLAs 28, 30 to lower the vertically slideable mast members 18, 20, and then retracts rod 94 of PCCA 92 to lower carriage 22 on innermost mast member 20. Counterbalance valves 210, 212 prevent mast lift rods 36, 38 from extending when rod 94 of PCCA 92 is retracting.

The sequencing counterbalance valves shown in FIG. 9 are shown in detail in FIGS. 10A and 10B, and comprise a pair of pilot operated counterbalance valves 210, 212 for PCCA 92, a pair of pilot operated counterbalance valves 210, 212 for MLA 28 and a pair of pilot operated counterbalance valves 210, 212 for MLA 30 (FIG. 10B shows a pair for one of MLA 28 or 30). A rod end counterbalance valve 212 of a counterbalance pair 210, 212 fluidly communicates with an orifice O1 at the rod end of an actuator 28, 30 or 92, and a bore end counterbalance valve 210 of the counterbalance pair 210, 212 fluidly communicates with an orifice O2 at the bore end of an actuator 28, 30 or 92. Each counterbalance valve 210, 212 has an operator piloted by a supply line pressure operative at a predetermined pressure to release compression fluid from the actuator (28, 30 or 92) controlled by the counterbalance valve. Rod end counterbalance valve 212 of each actuator 28, 30 and 92 has an operator 214 piloted by pressure from first supply line 206 to the bore ends of actuators 28, 30 and 92. Bore end counterbalance valve 210 of each actuator 38, 30 and 92 has an operator 216 piloted by pressure from second supply line 208 to the rod end of actuators 38, 30 and 92.

Operator 214 of rod end counterbalance valve 212 for PCCA 92 is set to operate at less pressure than operator 214 of the rod end counterbalance valve 212 of each MLA 28, 30, such that on supply of fluid pressure through first supply line 206A to the bore end of PCCA 92 and through first supply line 206B to the bore ends of MLAs 28, 30, operator 214 of rod end counterbalance valve 212 of PCCA 92 operates to release compression fluid from PCCA 92 while operator 214 of rod end counterbalance valve 212 for MLAs 28, 30 does not. This allows supply pressure to the bore end of PCCA 92 to stroke rod 94 of PCCA 92 to full extension and raise carriage 22. With rod 94 fully stroked, the hydraulic pump supplying hydraulic fluid in the supply lines 206A and 206B continues to try to pump fluid into the lines 206A and 206B, and as a result the supply pressure to the bore ends of the actuators 28, 30 builds sufficiently for operator 214 of rod end counterbalance valves 212 of MLAs 28, 30 to operate to release rod end compression fluid in MLAs 28, 30, allowing the supply pressure to the bore end of MLAs 28, 30 to extend mast lift rods 36, 38 to directly raise middle mast member 18 and indirectly raise inner mast member 20.

The operator 216 of bore end counterbalance valve 210 of PCCA 92 is set for more pressure to operate than operator 216 of bore end counterbalance valve 210 of each MLA 28, 30, such that on supply of fluid pressure through the second supply line 208A to the rod end of PCCA 92 and through the second supply line 208B to the rod end of MLAs 28, 30, operator 216 of bore end counterbalance valve 210 of MLAs 28, 30 releases compression fluid while operator 216 of bore end counterbalance valve 210 for PCCA 92 does not, allowing supply pressure through line 208B to the rod end of MLAs 28, 30 to retract mast lift rods 36, 38 to full retraction before the supply pressure through line 208A to the rod end of PCCA 92 builds sufficiently to operate operator 216 of bore end counterbalance valve 210 of PCCA 92 and release compression fluid, allowing supply pressure through line 208A to the rod end of PCCA 92 to retract rod 94 of PCCA 92.

In an exemplary embodiment, bore end counterbalance valve 210 and rod end valve 212 each are 4-branch cross circuits that include a normally closed relief valve component 226 and a check valve component 228. First 4-branch cross circuit 210 of each actuator 28, 30 and 92 fluidly communicates with the bore end orifice O2 of the actuator. Second 4-branch cross circuit 212 of each actuator 28, 30 and 92 fluidly communicates with the rod end orifice O1 of each actuator. First pressure supply line branch 206A is in fluid communication with first 4-branch cross circuit 210 for PCCA 92 and first pressure supply line branch 206B is in fluid communication with first 4-branch cross circuit 210 for MLAs 28, 30. Second pressure supply line branch 208A is in fluid communication with second 4-branch cross circuit 212 for PCCA 92 and second pressure supply line branch 208B is in fluid communication with second 4-branch cross circuit 212 for MLAs 28, 30.

Each one of the 4-branch cross circuits 210, 212 comprises a first branch 218, in fluid communication with source 202 of fluid pressure, and second, third and fourth branches, respectively 222, 224, 236, each in fluid communication with first branch 218. Second branch 222 is in fluid communication with a 3-port valve 226 through a first port P1 of three ports P1, P2 and P3 of valve 226. Third branch 224 is in fluid communication through a check valve 228 to (i) a primary branch 230 in fluid communication with one orifice of the actuator it serves (28, 30 or 92), (ii) a secondary branch 232 in fluid communication with third port P3 of valve 226, and (iii) a tertiary branch 234 in fluid communication with second port P2 of valve 226. Fourth branch 236 of each 4-branch cross circuit 210, 212 is in piloting fluid communication with the operator (214 or 216) of the 3-port valve 226 of the other of the two 4-branch cross circuits, that is, the fourth branch 236 of 4-branch cross circuit 210 for the bore end of an actuator 28, 30, 92 is in piloting fluid communication with the operator 214 of the S-port valve 226 for the rod end of an actuator 28, 30, 92, and the fourth branch 236 of 4-branch cross circuit 212 for the rod end of an actuator 28, 30, 92 is in piloting fluid communication with the operator 216 of the 3-port valve 226 for the bore end of an actuator 28, 30, 92.

Valve 226 has (i) an adjustable pressure setting spring 227 that maintains valve 226 in a normally closed position until pressure acting on externally piloted operator 214 or 216 overcomes the spring setting and connects ports P1 and P2, opening valve 226 and allowing flow from O1 or O2 through P2 thence to P1 and first branch 218 through branch 222.

When operator 214 is operated by fluid pressure from fourth branch 236 communicating supply pressure from 206A (for PCCA 92) or 206B (for MLAs 28, 30) through first branch 218, first and second ports P1 and P2 of valve 226 of four branch cross circuit 212 are connected, allowing fluid pressure through rod end orifice O1 to pass from primary branch 230 thence tertiary branch 234 through P2 thence P1 to second branch 222 and first branch 218 to fluid line 208A (for PCCA 92) or 208B (for MLAs 28, 30). When operator 216 is operated by fluid pressure from fourth branch 236 communicating supply pressure from 208A (for PCCA 92) or 208B (for MLAs 28, 30) through first branch 218, first and second ports P1 and P2 of valve 226 of four branch cross circuit 210 are connected, allowing fluid pressure through bore end orifice O2 to pass from primary branch 230 thence tertiary branch 234 through P2 thence P1 to second branch 222 and first branch 218 to fluid line 206A (for PCCA 92) or 206B (for MLAs 28, 30).

Tertiary branch 234 communicates pressure prom primary branch 230 that is in fluid communication with one orifice of the actuator it serves and provides an internal piloting of normally closed valve 226. Spring 227 is in fluid communication with third branch 224 of the 4-branch cross circuit. A predetermined pilot ratio for internal piloting tertiary branch 234 and valve 226 provides a relief function to hydraulic circuit 200 if pressure in the actuator end with which internal piloting line 234 is in fluid communication through primary line 230 exceeds an amount predetermined by the ratio. The ratio is factored off the pressure setting for spring 227.

Check valve 228 holds pressure in the actuator through the orifice O1 or O2 to which it communicates through primary branch 230. Thus pressure supplied to the actuator through branch 224 thence through primary branch 230 is checked and held when valves 226 are closed (not piloted open).

Figure 11:
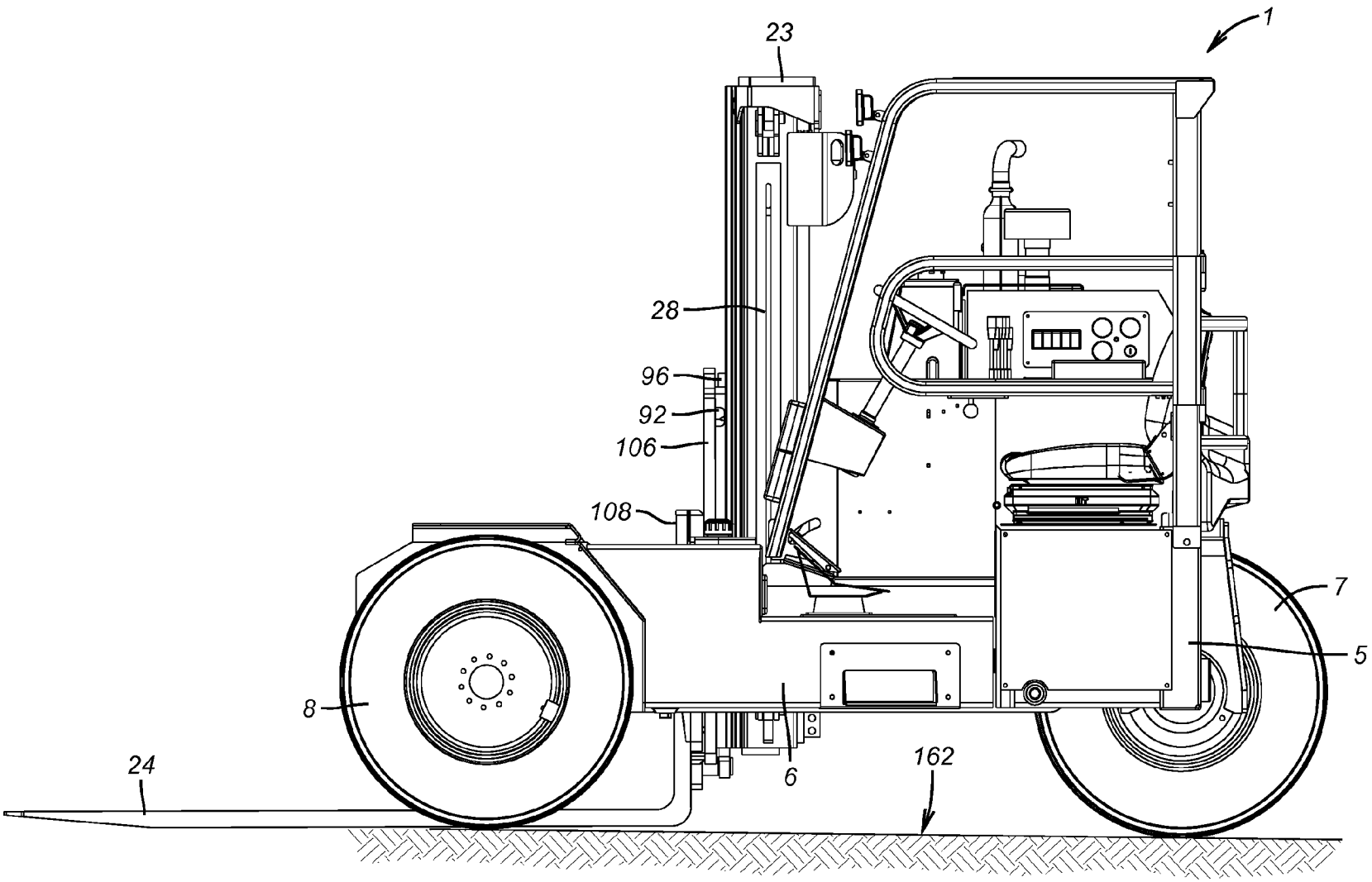
FIG. 11 is a side view of the truck mountable forklift of FIG. 1 to which the exemplary embodiment of a lift mast illustrated in FIG. 7 is attached, showing the fork carriage and forks and the mast members in lowered position.
Figure 12:
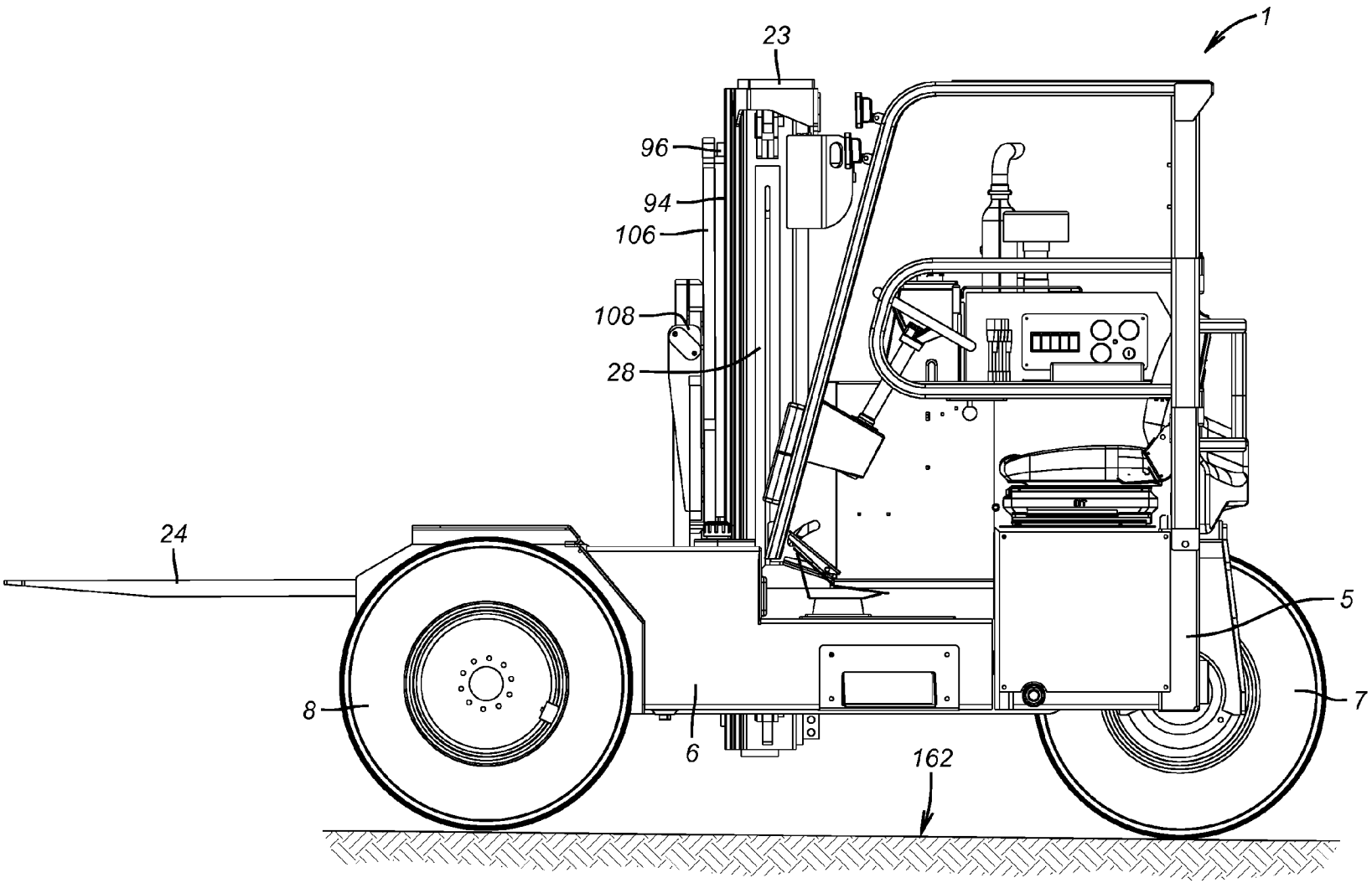
FIG. 12 is a side view of the truck mountable forklift of FIG. 1 to which an the exemplary embodiment of a lift mast illustrated in FIG. 7 is attached, with the fork carriage in raised position on an inner mast with all extensible mast members including the inner mast in lowered position.

FIG. 11 shows forklift 1 on surface 162 supporting the forklift. In FIG. 11, the fork carriage 22 and forks 24, 26 are on surface 162 in a fully lowered position, and extensible masts 18, 20 are fully lowered. Since the extensible masts 18, 20 extend only when pressure to them is higher than the lower pressure needed to lift carriage 22 as explained above, then whenever the fork carriage 22 is in its lowest position, extensible masts 18, 20 are at their lowest position. FIG. 12 shows forklift 1 with carriage 22 and forks 24, 26 in a raised position, with extensible masts 18, 20 remaining in a fully lowered position. The lower pressure needed to operate PCCA 92 and raise carriage 22 is insufficient to raise the rods 36, 38 of MLAs 28, 30 to raise extensible masts 18, 20.

In operation, a method of free lifting a carriage on a forklift truck having a multi-lift mast as hereinabove described in exemplary embodiments comprises (i) supplying fluid pressure in the first pressure supply lines 206A and 206B both to the valve fluidly communicating with the orifice at one end of the actuator (for example, the bore end, valve 210, and orifice O2) to supply fluid to the one end of the actuator and to the operator of the valve fluidly communicating with the orifice at the other end of the actuator (for example, the rod end, valve 212, orifice O1 and operator 214) until pressure suffices to operate the operator of the valve fluidly communicating with the orifice at the other end of the actuator (for example, operator 214), the operator on the valve communicating with the orifice at the other end of the PCCA (for example, operator 214) requiring less pressure to operate than the operators on the valve communicating with the orifice at the other end of the MLAs (for example, valves 212 and operators 214), the operator on the valve communicating with the orifice at the other end of the PCCA (for example, valve 212 and operator 214) operating to open the normally closed valve at the other end of the carriage actuator (for example, valve 214) to relieve pressure from such other end of the carriage actuator, and (ii) continuing to supply pressure to stroke the piston of the PCCA and raise the carriage 22 on the extensible mast member mounting the carriage to full extension without raising an extensible mast.

For an example of the sequencing providing free lift of the carriage operation before extension of the MLAs in a three stage mast assembly of the exemplary embodiment of FIGS. 1-8, with the hydraulic circuit of FIGS. 9 and 10A, 10B, assume the carriage 22 weighs 500 lbs and carries a workload of 3000 lbs on forks 24, 26. Assume the APSA of the bore end of the pistons of the PCCA is 4.9 $in^2$. The pressure required for PCCA 92 to lift the 3500 lbs combined weight of the carriage and the workload is 3500 lbs/4.9 $in^2$ or 714 psi. Assume middle mast 18 and inner mast 20 each weigh 350 lbs, and again, carriage 22 weighs 500 lbs and a workload weighs 3000 lbs. The weight to be lifted by the MLAs is the sum of 350 lbs (middle mast 18), 700 lbs (twice the weight of pulleyed inner mast 20), 1000 lbs (twice the weight of carriage 22) and 6000 lbs (twice the weight of the workload), a total of 8050 lbs. Accordingly, each MLA would have to lift 4025 lbs. Assume the APSA of the bore end of each MLA piston is 4 $in^2$. The pressure required for each MLA to lift 4025 lbs is 4025 lbs/4 $in^2$ or 1006 psi. The PCCA and MLA lifting pressures are close enough that assurance of free lift is obtained by provision of the exemplary embodiment of hydraulic circuit 200 and setting the pilot pressure for operator 214 of counterbalance valve 212 for the rod end of PCCA 92 to 1000 psi and setting the pilot pressure for operator 214 of counterbalance valve 212 for the rod end of MLAs 28, 30 to 1500 psi. When 714 psi is obtained in the bore end of PCCA 92, the piston of the PCCA will be unable to move against backpressure from incompressible (at these pressures) fluid in the rod end chamber of the PCCA cylinder, building pressure in the bore end of the PCCA until 1000 psi is obtained in the bore end of PCCA 92, when operator 214 of counterbalance valve 212 for the rod end of PCCA 92 piloted by line 236 will open that counterbalance valve for exit of hydraulic fluid from the rod end of PCCA 92, and the piston of PCCA 92 will begin its stroke upward. When fully stroked, pressure will build in supply lines 206A and 206 B, and when pressure reaches 1006 psi in the bore end of MLAs 28, 30, the pistons of MLAs 28, 30 will be unable to move against backpressure from incompressible (at these pressures) fluid in the rod end chamber of the MLA cylinders, building pressure in the bore end of MLAs 28. 30 until 1500 psi is obtained in the supply line 206B to bore end of MLAs 28, 30, operator 214 of counterbalance valve 212 for the rod end of MLAs 28, piloted by line 236 will open that counterbalance valve for exit of hydraulic fluid from the rod end of MLAs 28, 30, and the piston of MLAs 28, 30 will stroke upward. At a pilot ratio of 1:3, rod end pressure in the PCCA can be 3000 psi before pressure is relieved by internal piloting line 232, and in the MLA's rod end pressure can be 4500 psi before pressure is relieved by internal piloting line 232.

For lowering, the piloting pressures are reversed. In the example, the piloting pressure for the counterbalance valve 210 for the bore end of PCCA 92 would be 1500 psi and the piloting pressure for the counterbalance valve 210 for the bore end of MLAs 28, 30 would be 1000 psi. At a pilot ratio of 1:3, bore end pressure in the PCCA can be 4500 psi before pressure is relieved by internal piloting line 232, and in the MLA's bore end pressure can be 3000 psi before pressure is relieved by internal piloting line 232.

Two scenarios for piggybacking are accommodated. In one, the maximum elevation of the carriage on the extensible mast member on which the carrier is raised or lowered by the PCCA is adequate to raise the carriage forks to a level where they can be inserted in receivers for them on a vehicle. In another the maximum elevation of the carriage on the extensible mast member on which the carrier is raised or lowered by the PCCA is not adequate to raise the carriage forks to a level where they can be inserted in receivers for them on a vehicle, and it is necessary to elevate the forks higher by elevating the extensible mast that mounts the carriage. If the former scenario applies, proper sequencing raises the carriage to maximum elevation without raising the extensible mast mounting the carriage, or if the extensible mast is already elevated, in which case the carriage will also be fully elevated, as seen from the following description of operation of the hydraulic circuit, proper sequencing lowers the extensible mast member fully without lowering the fully elevated carriage, in either case, allowing forks on the carriage to be inserted into a vehicle forks receiver without allowing an extensible mast member or members to raise. However, if the latter scenario applies and the extensible mast member mounting the carriage is partially raised to further elevate the carriage so the forks can be inserted, the hydraulic circuit does not allow the extensible mast members of the MLAs to further lift during the piggybacking operation.

For example, assume again the right side up configuration for the actuators as shown in FIGS. 1-8. Assume the forklift weight to be lifted for piggybacking is 7500 lbs. As mentioned, the APSA of the bore end of the PCCA piston might be 4.9 $in^2$. Assume the APSA of the rod end of the PCCA is 3.14 $in^2$. As mentioned, the APSA of the bore end of each of the MLA pistons might be 4 $in^2$. Assume the APSA of the rod end of the MLAs is 1.9 $in^2$. Applying fluid pressure to the lowering supply lines 208A and 208B of the circuit opens counterbalance valve 210 on the bore end of MLAs 28, 30 when line pressure reaches 1000 psi, and the MLA piston would be ready to move unhindered by backpressure on the bore end chamber, but the pressure required for the MLA's to lift the forklift instead of the PCCA would be roughly 7500 lbs/1.9 $in^2$ or 3914 lbs. Since the MLA pistons are unable at 1000 psi to lift the load of the forklift, pressure would continue to build and reach 1500 psi, which would open counterbalance valve 210 on the bore end of PCCA 92. The pressure required for PCCA 92 to lift the 7500 lb forklift would be 7500 lbs/3.14 $in^2$ or 2388 psi, well shy of the 3914 psi required for the MLA rods to begin to retract. When 2388 psi is reached, the PCCA rod will retract and, unable to pull down the fixed carriage, will instead pull up the inner mast to which the bore end of the PCCA is attached, and lift of the inner mast brings with it the entire forklift. The counterbalance valves prevent the extensible masts of the MLA from rising during the operation.

Figure 13:
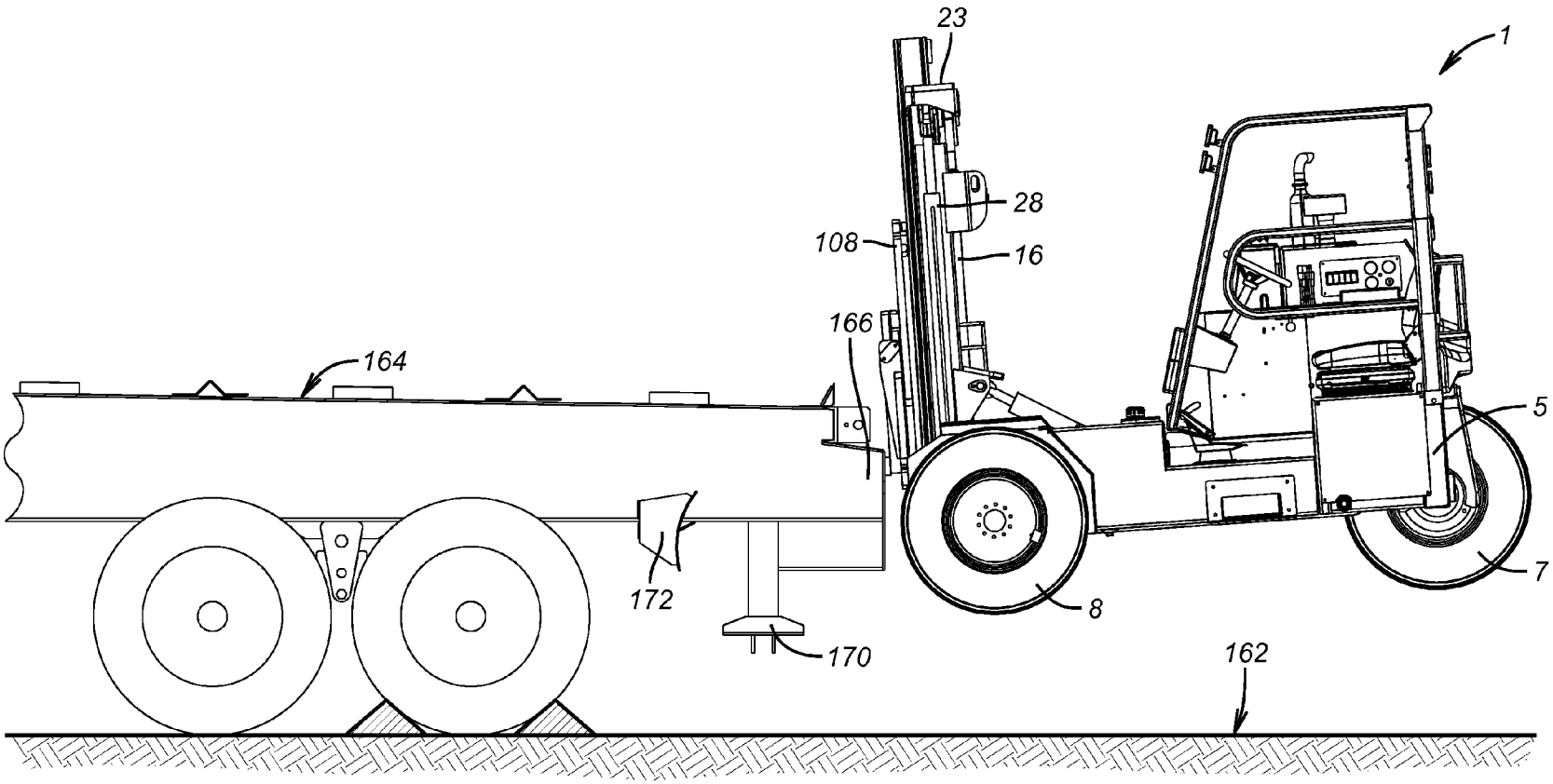
FIG. 13 is a side view of the truck mountable fork lift of FIG. 1 as negatively lifted mounted to the rear of a hauling vehicle.
Figure 14:
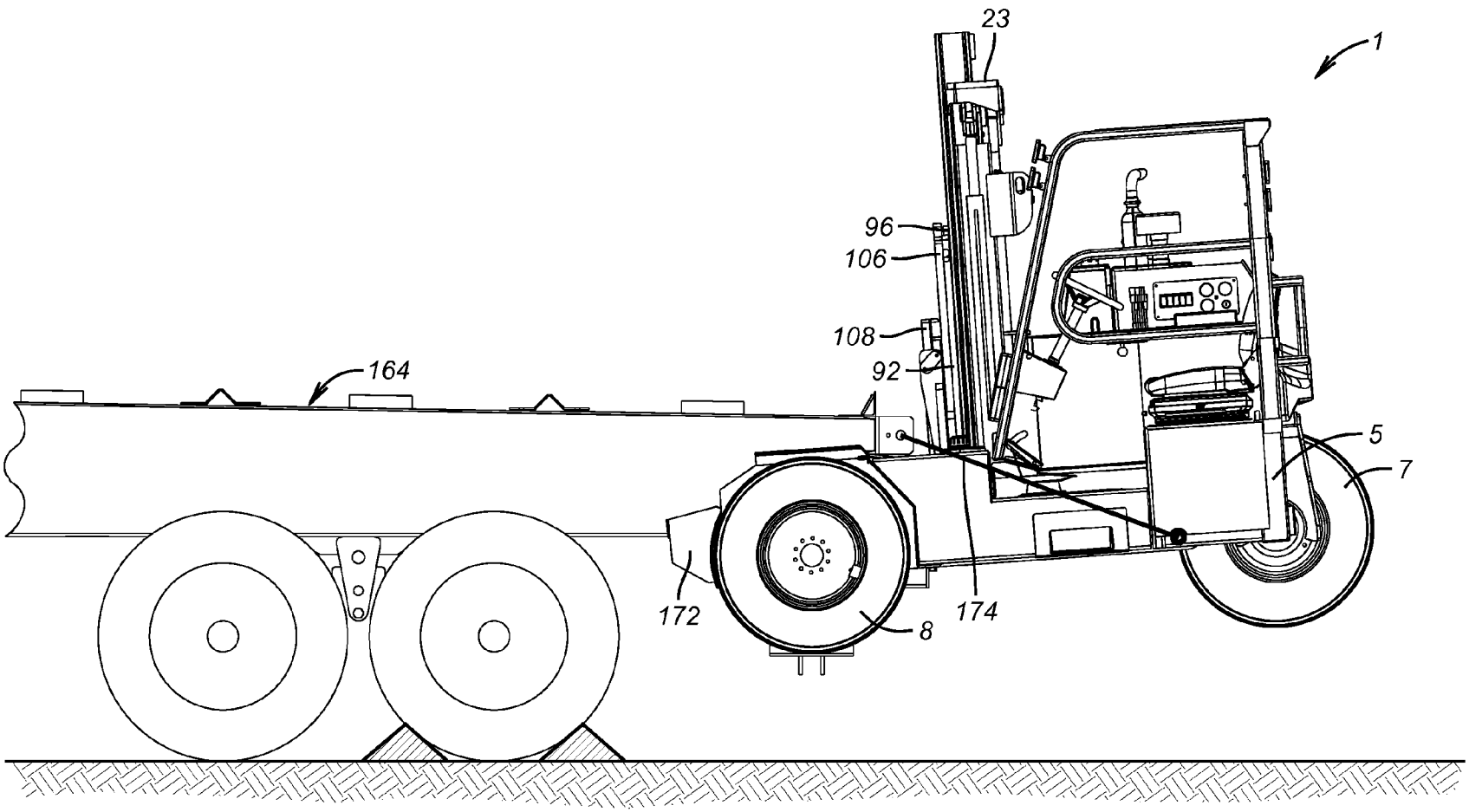
FIG. 14 is a side view of the truck mountable fork lift of FIG. 1 as negatively lifted mounted to the rear of a hauling vehicle, secured for hauling.

FIG. 13 shows a hauling vehicle 164 for transporting forklift truck 1. Vehicle 164 has receivers 166, 168 for forks 24, 26 on carriage 22. The method of piggybacking forklift 1 comprises operating the PCCA 92 to lift the forks 24, 26 on the carriage 22 to a height level with receivers 166, 168 on the vehicle, then advancing the forklift to inserting forks 24, 26 into receivers 166, 168 on vehicle 164, tilting mast 3 back to raise the rear tire 7 and then operating PCCA 92 as to lower carriage 22 and attached forks 24, 26, thereby causing carriage 22 to raise forklift truck 1 off surface 162. Optionally, this procedure may include operating the PCCA to maximum extension and then operating the MLAs 28, 30 until the forks 24, 26 on carriage 22 reach the height level with the receivers 166, 168, then next inserting forks 24, 26 into the receivers 166, 168 on the vehicle 164, followed by operating PCCA 92 as to lower carriage 22 and attached forks 24, 26, therefore causing carriage 22 to raise forklift truck 1 of the surface 162. This is shown in FIG. 13. As shown in FIG. 14, a hydraulic actuator (not shown) has retracted mast 3 on side rails 6 to place front tired wheels 8 on support members 170 suspended from vehicle 164, and mast 3 has been raised to lower front tired wheels 8 onto the support, braced by blocks 172. The engine is shut down and securing chains 174 attached to forklift 1 are fastened to vehicle 164. Mast 3 is then tilted forward to release hydraulic pressure, allowing forklift 1 to be supported by the securing chains, placing tension on the chains instead of the forks, carriage and masts. In transit, the securing chains bear the load of the forklift.

The above disclosed subject matter is to be considered illustrative, and not restrictive, and the appended claims are intended to cover all modifications, enhancements, and other embodiments that fall within the true scope of the present invention, which to the maximum extent allowed by law, is to be determined by the broadest permissible interpretation of the following claims and their equivalents, unrestricted or limited by the foregoing detailed descriptions of embodiments of the invention.

The invention claimed is:

1. A multi-lift mast assembly, comprising:

a vertical mast having a plurality of mast members of which one is stationary and at least one other is extensible, a pair of double acting hydraulic mast lift actuators having a rod end and an opposite bore end, each actuator extending between and connecting the stationary mast member and a slideably extensible mast member for slideably moving that extensible mast member relative to the stationary mast member, a carriage slideably mounted on an extensible mast member, a double acting positively connected carriage hydraulic actuator having a rod end an opposite bore end, such actuator being positively connected to the extensible mast member mounting the carriage and positively connected to the carriage, for positively slidingly lifting and lowering the carriage on the extensible mast member mounting the carriage, and a hydraulic circuit for the actuators comprising first and second hydraulic pressure supply lines for the mast lift and carriage actuators and a pair of pilot operated normally closed valves for each actuator, one valve of the pair fluidly communicating with an orifice at one end of an actuator and the first supply line, and the other valve of the pair fluidly communicating with an orifice at the other end of the same actuator and the second supply line, each valve having an operator piloted by a supply line pressure and operative at a predetermined pressure to release fluid from the orifice with which it communicates, the valve fluidly communicating with the orifice at the one end of the actuator having an operator piloted by pressure in the second supply line to the other end of the same actuator, and the valve fluidly communicating with an orifice at the other end of same actuator having an operator piloted by pressure in the first supply line to the one end of the same actuator, the operator of the valve for the one end of the positively connected carriage actuator operating at greater pressure than the operator of the valve for the other end of the carriage actuator, and the operator of the valve for the one end of each of the mast lift actuators operating at lesser pressure than the operator of the valve for the other end of the same mast lift actuator.

2. The mast assembly of claim 1 in which the hydraulic circuit includes a check valve opening on pressure supplied by a supply line, and wherein said pair of pilot operated normally closed valves comprises first and second 4-branch cross circuits for each actuator, the first 4-branch cross circuit for each actuator fluidly communicating with said one end of the actuator for regulating said one end of the actuator, and the second 4-branch cross circuit for each actuator fluidly communicating with said other end of the actuator for regulating such other end of the actuator, said first supply line in fluid communication with the first 4-branch cross circuit for the positively connected carriage actuator and the first 4-branch cross circuit for the mast lift actuators, and said second supply line in fluid communication with the second 4-branch cross circuit for the positively connected carriage actuator and the second 4-branch cross circuit for the mast lift actuators, each 4-branch cross circuit comprising:

a first branch in fluid communication with said supply source of fluid pressure, and second, third and fourth branches in fluid communication with the first branch, said second branch in fluid communication with a normally closed 3-port valve through a first of the three ports, the second port fluidly communicating with an orifice at the end of the actuator regulated by the cross circuit, the 3-port valve having said piloted operator, said operator connecting the first and second ports to the second branch on operation of the operator, and an adjustable pressure setting spring for maintaining the valve closed until attainment of a pressure operative on said operator exceeding the pressure setting, said third branch in fluid communication through said check valve to a primary branch in fluid communication with an end of the actuator, a secondary branch in fluid communication with said second port and said orifice at the end of the actuator regulated by the cross circuit, and a tertiary branch in fluid communication with the third port for internally piloting opening of the valve on attainment of a pressure at the orifice at the end of the actuator regulated by the cross circuit in excess of a predetermined pilot ratio for said piloted operator, and a fourth branch in piloting fluid communication with the operator of the 3-port valve of the other of the two 4-branch cross circuits.

3. The multi-lift mast assembly of claim 2 in which the actuators comprise a piston moveable in a cylinder and in which the total available surface area of the piston or pistons on the lift side of the one or more positively connected carriage actuators equals or is greater than the total available surface area of pistons on the lift side of the mast lift actuators divided by the number of extensible mast members.

4. A forklift truck comprising an attached mast assembly as claimed in claim 3.

5. A forklift truck comprising an attached mast assembly as claimed in claim 1.

6. A multi-lift mast assembly, comprising:

a vertical mast having a plurality of mast members of which one is stationary and at least one other is extensible, a pair of double acting hydraulic mast lift actuators each comprising a piston to which a rod is attached on one side and moveable in a cylinder between a rod end and an opposite bore end, each actuator extending between and connecting the stationary mast member and a slideably extensible mast member for slideably moving that extensible mast member relative to the stationary mast member, a carriage slideably mounted on an extensible mast member, a double acting positively connected carriage hydraulic actuator comprising a piston to which a rod is attached on one side and moveable in a cylinder between a rod end and an opposite bore end, such actuator being positively connected to the extensible mast member mounting the carriage and positively connected to the carriage, for positively slidingly lifting and lowering the carriage on the extensible mast member mounting the carriage, the total available surface area of the piston or pistons on the lift side of the positively connected carriage actuator about equaling or exceeding the total available surface area of the lift side of the mast lift actuators divided by the number of extensible mast members, and a hydraulic circuit for the actuators comprising first and second hydraulic pressure supply lines and a plurality of paired counterbalance valves, one pair for each actuator, said pairs operatively connected to said supply lines and to the actuators, one valve of each pair being operatively connected to the bore end of an actuator and the other to the rod end of the same actuator, said counterbalance valves each comprising a check valve and a piloted spring biased normally closed pressure relief valve, said check valve opening on pressure supplied by a said supply line with which it is in fluid communication, said pressure relief valves operating:

in response to supply of a first fluid pressure in the first pressure supply line to first operate the paired pressure relief valves for the positively connected carriage actuator to relieve pressure from the rod end of the carriage actuator and raise the carriage on the extensible mast member mounting the carriage to full extension, and in response to a second fluid pressure in the first supply line exceeding the first fluid pressure, then to operate the paired pressure relief valves for the mast lift actuators to relieve pressure from the rod end of the mast lift actuators and raise an extensible mast member, and in response to supply of a first fluid pressure in the second pressure supply line to first operate the paired pressure relief valves for the mast lift actuators to relieve pressure from the bore end of the mast lift actuators and lower the extensible mast member fully, and in response to a second fluid pressure in the second supply line exceeding the first fluid pressure in the same line, then to operate the paired pressure relief valves for the positively connected carriage actuator to relieve pressure from the bore end of the carriage actuator and lower the carriage on the extensible mast member mounting the carriage, said valves preventing said mast lift actuators from raising an extensible mast member when the positively connected carriage actuator is operated to lower the carriage.

7. A forklift truck comprising an attached mast assembly as claimed in claim 6.

8. A multi-lift mast assembly, comprising:

a vertical mast having a plurality of mast members of which one is stationary and at least one other is extensible, a pair of double acting hydraulic mast lift actuators having a rod end and an opposite bore end, each actuator extending between and connecting the stationary mast member and a slideably extensible mast member for slideably moving that extensible mast member relative to the stationary mast member, a carriage slideably mounted on an extensible mast member, a double acting positively connected carriage hydraulic actuator having a rod end, an opposite bore end, and a piston movable in a cylinder between said ends, such actuator being positively connected to the extensible mast member mounting the carriage and positively connected to the carriage, for positively slidingly lifting and lowering the carriage on the extensible mast member mounting the carriage, and hydraulic circuitry for said mast lift and carriage actuators for sequentially staging the movement of said mast lift actuators and said carriage actuator such that free lift and negative lift of the carriage is obtained without extension of the one or more extensible mast members.

9. A forklift truck comprising an attached mast assembly as claimed in claim 8.

10. The multi-lift mast assembly of claim 8 in which said hydraulic circuitry for said mast lift and carriage actuators for sequentially staging the movement of said mast lift actuators and said carriage actuator operates such that the carriage fully extends before an extensible mast member extends and such that said one or more extensible mast members lower before said carriage lowers and do not extend when the carriage is lowering.

11. A forklift truck comprising an attached mast assembly as claimed in claim 10.

12. The multi-lift mast assembly of claim 10 in which said hydraulic circuitry for said mast lift and carriage actuators comprises first and second hydraulic pressure supply lines and a plurality of paired counterbalance valves, one pair for each actuator, said pairs operatively connected to said supply lines and to the actuators, one valve of each pair being operatively connected to the bore end of an actuator and the other to the rod end of the same actuator, said counterbalance valves each comprising a check valve and a piloted spring biased normally closed pressure relief valve.

13. A forklift truck comprising an attached mast assembly as claimed in claim 12.

14. The multi-lift mast assembly of claim 8 in which the total available surface area of the piston or pistons on the lift side of the one or more positively connected carriage actuators equals or is greater than the total available surface area of pistons of the lift side of the mast lift actuators divided by the number of extensible mast members.

15. A forklift truck comprising an attached mast assembly as claimed in claim 14.

* * * * *